US005505261A

United States Patent [19]

Huber et al.

[11] Patent Number: 5,505,261

[45] Date of Patent: Apr. 9, 1996

[54] FIRING HEAD CONNECTED BETWEEN A COILED TUBING AND A PERFORATING GUN ADAPTED TO MOVE FREELY WITHIN A TUBING STRING AND ACTUATED BY FLUID PRESSURE IN THE COILED TUBING

[75] Inventors: Klaus B. Huber, Sugarland; A. Glen Edwards, Hockley; Thomas M. Sayers, Houston; Edward G. Smith, Jr., San Leon, all of Tex.

[73] Assignee: Schlumberger Technology Corporation, Houston, Tex.

[21] Appl. No.: 405,421

[22] Filed: Mar. 15, 1995

Related U.S. Application Data

[63] Continuation of Ser. No. 255,020, Jun. 7, 1994, abandoned.

[51] Int. Cl.[6] ..... E21B 43/116; E21B 43/12

[52] U.S. Cl. ..... 166/297; 166/55.1; 166/151

[58] Field of Search ..... 166/297, 55, 55.1, 166/55.2, 151, 63; 175/4.56

[56] References Cited

U.S. PATENT DOCUMENTS

| | | | |
|---|---|---|---|
| 4,509,604 | 4/1985 | Upchurch | 175/4.52 |
| 4,560,000 | 12/1985 | Upchurch | 166/55.1 |
| 4,564,076 | 1/1986 | Vann et al. | 175/4.52 |
| 4,648,470 | 3/1987 | Gambertoglio | 175/4.54 |
| 4,655,298 | 4/1987 | George et al. | 175/4.52 |
| 4,726,610 | 2/1988 | George et al. | 285/39 |
| 4,756,371 | 7/1988 | Brieger | 166/312 |
| 4,817,718 | 4/1989 | Nelson et al. | 166/297 |
| 4,862,964 | 9/1989 | George et al. | 166/297 |
| 4,880,056 | 11/1989 | Nelson et al. | 166/51 |
| 5,050,672 | 9/1991 | Huber et al. . | |
| 5,161,616 | 11/1992 | Colla | 166/297 |
| 5,287,741 | 2/1994 | Schultz et al. . | |

FOREIGN PATENT DOCUMENTS

| | | |
|---|---|---|
| 0586223A2 | 3/1994 | European Pat. Off. . |
| 0647765A2 | 4/1995 | European Pat. Off. . |

*Primary Examiner*—Frank S. Tsay

*Attorney, Agent, or Firm*—Henry N. Garrana; John H. Bouchard

[57] ABSTRACT

A firing head adapted to connected between a coiled tubing and a perforating gun, is sized and shaped to enable it to move freely within a tubing string in the wellbore, may be actuated by fluid pressure within the coiled tubing, and includes a circulation and recirculation feature wherein wellbore fluid may be circulated through the firing head between the coiled tubing and an annulus around the tubing string, the circulation taking place either before or after detonation of the perforating gun. Three firing heads are discussed. One such firing head is a Circulation Direction Firing (CDF) Head. The CDF firing head circulates fluid from the wellbore to the coiled tubing and depresses a piston. Then, fluid pressure from the coiled tubing lifts the piston uncovering locking balls and propelling a firing pin to a booster of a detonating cord detonating the CDF firing head. Fluid circulation from the coiled tubing to the wellbore annulus begins after the CDF firing head detonates. Another such firing head is a Circulation Ball Firing (CBF) Head. The CBF firing head circulates fluid from the wellbore to the coiled tubing, receives a ball, and uses fluid pressure in the coiled tubing to lift a piston, uncover the locking balls and detonate the CBF firing head. Another such firing head is a Ball Actuated Circulation Firing (BCF) Head. The BCF firing head circulates fluid from the wellbore to the coiled tubing, receives a ball from the wellbore surface, and uses fluid pressure in the coiled tubing to push a piston downwardly which uncovers the locking balls and detonates the BCF firing head. Recirculation is permitted after the firing head detonates.

32 Claims, 18 Drawing Sheets

| |
|---|
| FIG. 2 |
| FIG. 3 |
| FIG. 4 |

FIG. 15
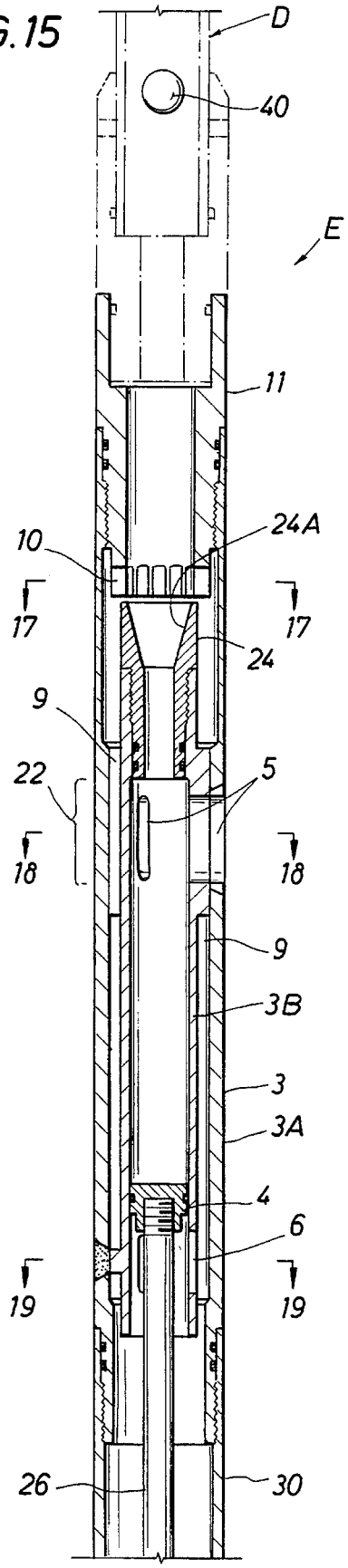
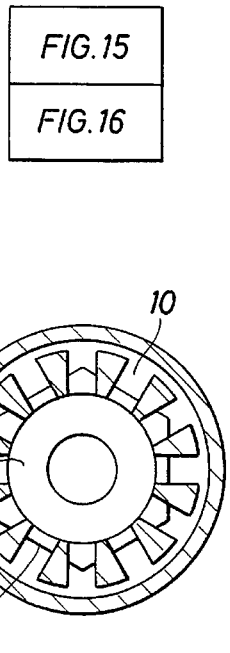
FIG. 17
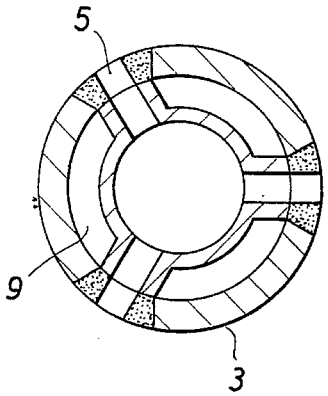
FIG. 18
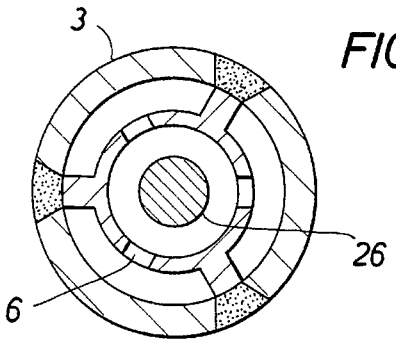
FIG. 19

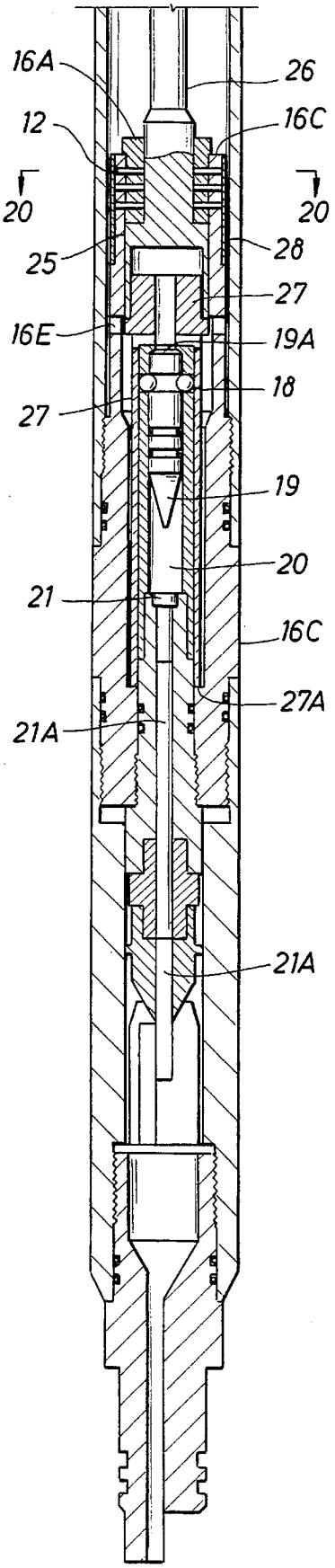
FIG. 16
FIG. 20
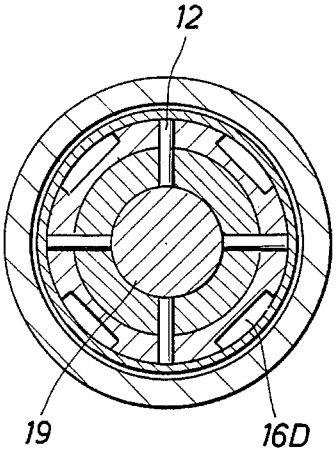

| |
|---|
| FIG. 23 |
| FIG. 24 |
| FIG. 25 |

| |
|---|
| FIG. 35 |
| FIG. 36 |
| FIG. 37 |

FIRING HEAD CONNECTED BETWEEN A COILED TUBING AND A PERFORATING GUN ADAPTED TO MOVE FREELY WITHIN A TUBING STRING AND ACTUATED BY FLUID PRESSURE IN THE COILED TUBING

This is a continuation of application Ser. No. 08/255,020 filed Jun. 7, 1994, now abandoned.

BACKGROUND OF THE INVENTION

The subject matter of the present invention relates to a firing head adapted for use in a perforating gun, and more particularly, to a firing head and perforating gun connected to a coiled tubing which may be disposed within a tubing string in a wellbore and is adapted to move freely within the tubing string, the firing head detonating a booster of a detonating cord and initiating the propagation of a detonation wave in the detonating cord in response to a fluid pressure disposed within the coiled tubing, the detonation wave detonating the perforating gun.

The use of coiled tubing in oil well related operations is increasing in popularity. The reason is relatively simple. Instead of lowering wellbore equipment into a wellbore as part of a tubing string, a much more economical alternative approach involves the lowering of the wellbore equipment into the tubing string itself on the end of a coiled tubing. It is much more expensive to remove a tubing string from a wellbore than it is to remove a coiled tubing from a tubing string. A perforating gun is one example of such wellbore equipment. The perforating gun includes a firing head for detonating the perforating gun and perforating a formation traversed by the wellbore. Since the aforementioned alternative approach is preferred, a new firing head adapted for use in a perforating gun is needed, one which can be connected to a coiled tubing on one end and to the perforating gun on the other end, one which is sized and shaped to allow the firing head and perforating gun to move freely within the tubing string, and one which can can be detonated in response to a fluid pressure in the coiled tubing. In addition, since many common oil field operations require circulation of wellbore fluids or pumping fluids into the formation, the new firing head should include a circulating feature for enabling fluids in an annulus defined by the tubing string or the wellbore to circulate through the firing head and into the coiled tubing, or for enabling fluids in the coiled tubing to circulate from the coiled tubing to the annulus, the circulation taking place before and/or after the perforating gun perforates the formation.

SUMMARY OF THE INVENTION

Accordingly, it is a primary object of the present invention to provide a firing head adapted to be use with a perforating gun in a wellbore which may be connected between a coiled tubing and the perforating gun.

It is a further object of the present invention to provide a firing head adapted to be use with a perforating gun in a wellbore which may be connected between a coiled tubing and the perforating gun and is sized and shaped to enable it to move freely within a tubing string in the wellbore.

It is a further object of the present invention to provide a firing head adapted to be use with a perforating gun in a wellbore which may be connected between a coiled tubing and the perforating gun, is sized and shaped to enable it to move freely within a tubing string in the wellbore, and may be actuated by fluid pressure within the coiled tubing.

It is a further object of the present invention to provide a firing head adapted to be use with a perforating gun in a wellbore which may be connected between a coiled tubing and the perforating gun, is sized and shaped to enable it to move freely within a tubing string in the wellbore, may be actuated by fluid pressure within the coiled tubing, and includes a circulation feature wherein wellbore fluid may be circulated through the firing head between the coiled tubing and an annulus of the wellbore, the circulation taking place either before or after detonation of the perforating gun.

It is a further object of the present invention to provide a firing head adapted to be use with a perforating gun in a wellbore which may be connected between a coiled tubing and the perforating gun, is sized and shaped to enable it to move freely within a tubing string in the wellbore, may be actuated by fluid pressure within the coiled tubing, and includes a circulation feature which enables a fluid in the tubing string or in the wellbore to circulate through the firing head and into the coiled tubing before and/or after detonation of the perforating gun.

In accordance with these and other objects of the present invention, one such firing head in accordance with the present invention is known as a Circulation Direction Firing Head, or CDF. The CDF firing head is connected between a coiled tubing and a perforating gun, the coiled tubing, firing head, and perforating gun being adapted to move freely within a tubing string which is disposed in a wellbore. The CDF firing head initially allows for reverse circulation of fluid from an annulus of the wellbore and toward an interior of the coiled tubing by depressing a piston and simultaneously filling the coiled tubing with wellbore fluid. When the fluid pressure in the coiled tubing equals rathole pressure, the biasing force of a spring returns the piston to its neutral position. When the piston is lifted upwardly by increasing the pressure inside the coiled tubing to a predetermined amount, the shear pin is sheared, and four locking balls are uncovered which initially lock a firing pin in an elevated position. When the locking balls are uncovered, the firing pin is propelled toward a booster of a detonating cord of the perforating gun thereby detonating the gun.

Another such firing head in accordance with another embodiment of the present invention is known as a Circulation Ball Firing Head, or CBF. The CBF firing head is connected between the coiled tubing and a perforating gun and is adapted to move freely within a tubing string disposed in the wellbore. The CBF firing head initially allows for reverse circulation of fluid from an annulus of the wellbore and toward an interior of the coiled tubing for filling the coiled tubing with wellbore fluid, subsequently receives a ball which covers a center bore of the CBF firing head and blocks the center bore, diverting the fluid pressure in the coiled tubing to the bottom side of a piston, shears the shear pins and lifts the piston upwardly which uncovers four locking balls. The locking balls initially lock a firing pin in an elevated position. However, when the locking balls are uncovered, the locking balls no longer prevent the firing pin from being propelled toward a booster of a detonating cord. As a result, the firing pin is subsequently propelled toward the booster of the detonating cord of the perforating gun which detonates the gun.

Still another such firing head in accordance with another embodiment of the present invention is known as a Ball Actuated Circulation Firing Head, or BCF. The BCF firing head is connected between the coiled tubing and the perforating gun and is adapted to move freely within a tubing string disposed in the wellbore. The BCF firing head initially allows for reverse circulation of fluid from a rathole annulus of the wellbore and toward an interior of the coiled tubing for filling the coiled tubing with the fluid, or circulation from the coiled tubing to the rathole, subsequently receives a ball which covers a center bore of the BCF firing head and blocks the center bore and, using the fluid pressure in the coiled tubing, pushes a piston downwardly, shearing the shear pins, which uncovers four locking balls. The locking balls lock a firing pin in an elevated position. However, when the locking balls are uncovered, the firing pin is propelled toward a booster of a detonating cord of the perforating gun. When the firing pin strikes the booster, a detonation wave propagates in the detonating cord which detonates the perforating gun.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIGS. 15 through 25 illustrate the Circulation Ball Firing Head (CBF firing head) in accordance with another embodiment of the present invention.

DETAILED DESCRIPTION OF THE PREFERRED EMBODIMENT

Figure 1A:
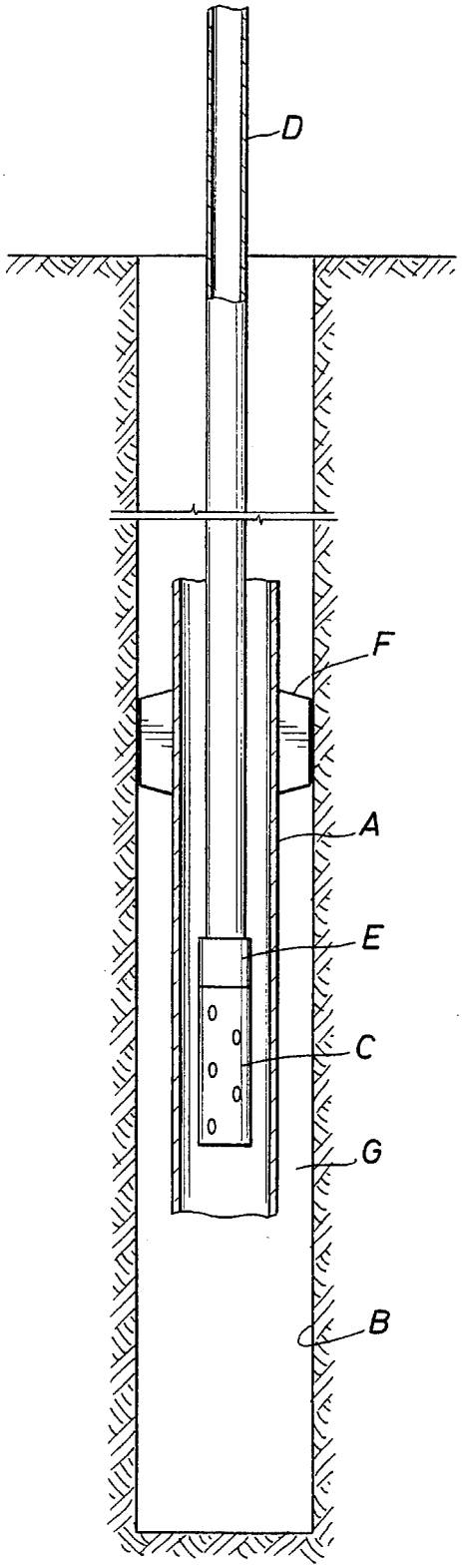
FIGS. 1*a* and 1*b* illustrate a tubing string disposed in a wellbore and a coiled tubing firing head in accordance with the present invention connected between a coiled tubing and a perforating gun, the coiled tubing, firing head, and perforating gun being illustrated to move free within the tubing string in the wellbore.
Figure 1B:
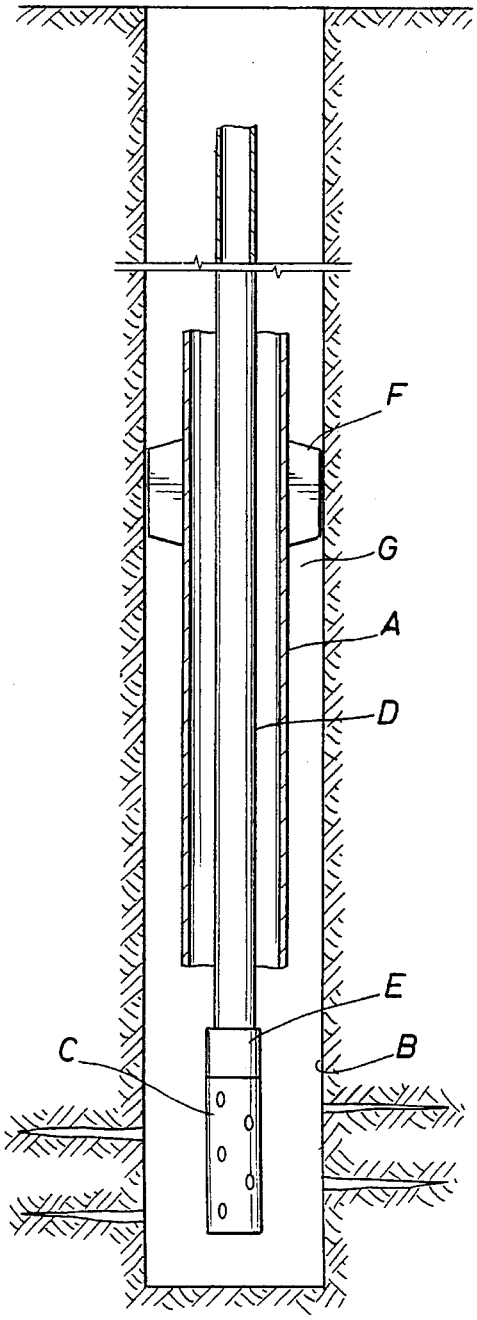

Referring to FIGS. 1*a* and 1*b*, a tubing string A is disposed in a wellbore B. A packer F seals the tubing string A to a wall of the wellbore B and isolates an annulus interval above the packer F from an annulus interval G below the packer F, hereinafter called "the rathole G". A perforating gun C is disposed within the tubing string A and is being lowered into the tubing string A on a section of coiled tubing D. A coiled tubing firing head E is connected between the coiled tubing D and the perforating gun C for firing and detonating the perforating gun C. As shown in FIG. 1*a* and in FIG. 1*b*, the perforating gun C, the firing head E, and the coiled tubing D are sized and shaped in a manner which allows the gun C, firing head E and coiled tubing D to move freely within the tubing string A, in either the upwardly or downwardly directions. Therefore, if the firing head E fails to detonate and a repair operation is needed, instead of removing the tubing string A from the wellbore B, the coiled tubing D, firing head E, and perforating gun C may be removed from within the tubing string A. As a result, large amounts of time and money is saved in performing the repair operation. Furthermore, the coiled tubing D is adapted to contain a fluid under pressure, and the firing head E is adapted to detonate in response to the fluid pressure disposed within the coiled tubing D. Although not shown in FIGS. 1*a* and 1*b*, the firing head E includes a circulating feature which allows the fluid, disposed in the tubing string A or within the wellbore B, to circulate into the firing head E and into the coiled tubing D. This allows the coiled tubing to fill as it is run in the well. Where check valves are run in the coiled tubing string (above the firing head), the CBF and the BCF firing heads E discussed below will allow fluid to be pumped into the coiled tubing and to circulate out through the firing head. This is often necessary to prevent collapse of the coiled tubing D.

Three different types of the coiled tubing firing head E will be discussed in the following paragraphs of this detailed description: (1) a Circulation Direction Firing Head (hereinafter called "the CDF firing head"), (2) a Circulation Ball Firing Head (hereinafter called "the CBF firing head"), and (3) a Ball Actuated Circulation Firing Head (hereinafter called "the BCF firing head").

By way of introduction, the CDF and CBF coiled tubing firing heads described below can be initiated either with the well underbalanced or with the well overbalanced. Both of these firing heads are initiated by a predetermined tubing pressure increase, yet they are insensitive to the absolute pressure around the firing head, even though the firing pin, once unlocked, requires a minimum of 300 psi of hydrostatic pressure to set off the percussion detonator. With each of these firing heads, it is possible to circulate fluid through the head and into the coiled tubing without detonating the firing head and initiating a firing train. These firing heads address the stimulation, workover, and plug to abandon markets, with one of the main applications being coiled tubing perforating. Sensitivity to the direction of circulation varies with the tool used. By changing only four parts, a CDF firing head can be converted to a CBF firing head.

The CDF firing head is sensitive to the direction of the circulation. The firing sequence is started by building up pressure in the coiled tubing. The CDF firing head provides for reverse circulation, tubing fill-up prior to firing the perforating guns (provided there are no back pressure valves in the string above the head), and circulation in both directions after firing.

The CBF firing head requires a ball to be pumped, dropped or placed on the ball seat, thus allowing an increase of the coiled tubing pressure to initiate the firing process. The CBF firing head allows circulation in either direction prior to landing the ball on the seat (provided there are no back pressure valves in the string above the head) and after firing the guns. However, the CBF firing head does require landing the ball on the seat and pressuring up on the tubing to initiate the firing sequence. With the CBF firing head, the flow area is restricted to the ball seat diameter until firing is initiated and the ball seat is removed from the flow path (and bypassed by the fluid).

The BCF coiled tubing firing head is a coiled tubing/tubing conveyed perforating firing head designed to fire at a preset differential pressure between tubing pressure and the annulus pressure while allowing circulation prior to firing and after firing in either direction, provided there are no back pressure valves in the coiled tubing string above the BCF firing head. Prior to firing the BCF firing head, the flow area of the tool is limited to the internal diameter of the ball seat. After firing, the flow area is greater than the internal diameter of many types of coiled tubing. Prior to firing, water hammer is reduced by the triangular pyramid located in the interior of the piston which is shaped to easily divert fluid from the tubing, through the slots, and into the annulus.

Figure 2:
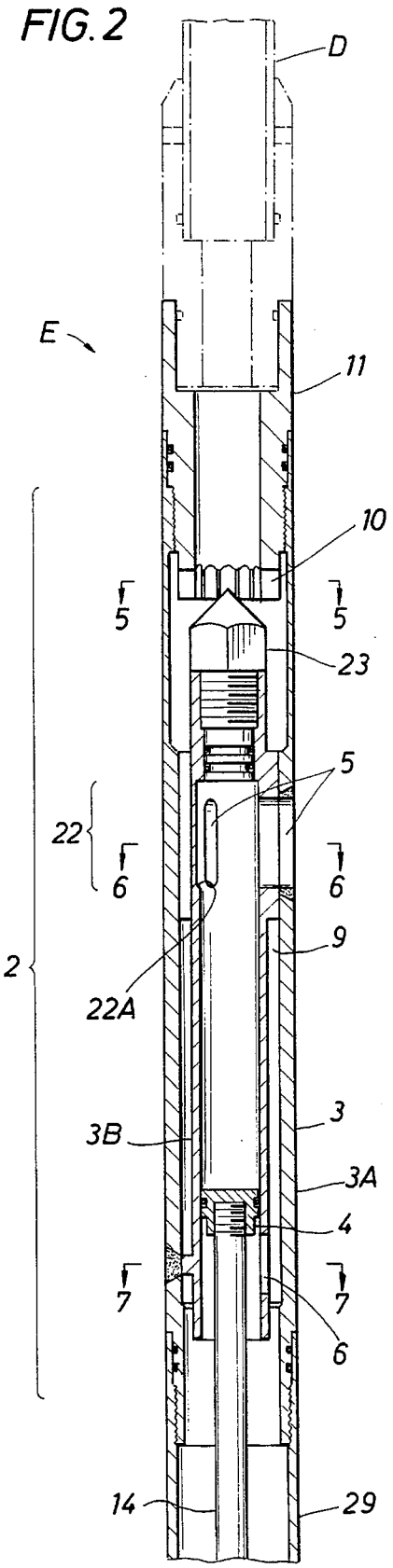
FIGS. 2 through 14 illustrate the Circulation Direction Firing Head (CDF firing head) in accordance with one embodiment of the present invention.
Figure 5:
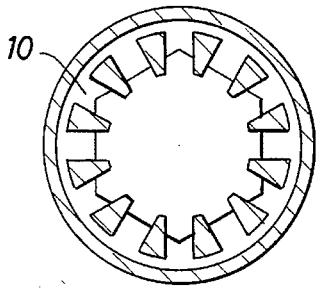
Figure 6:
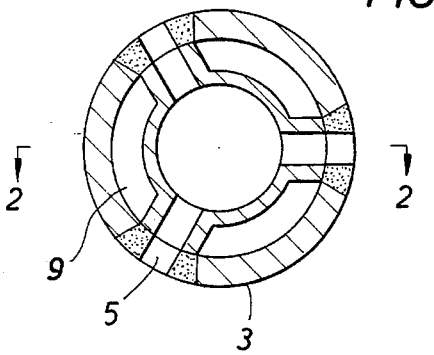
Figure 7:
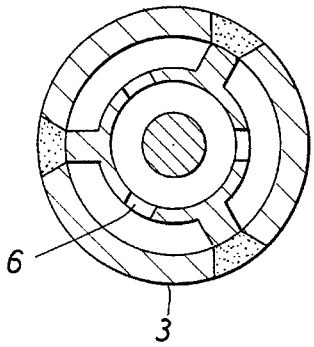
Figure 3:
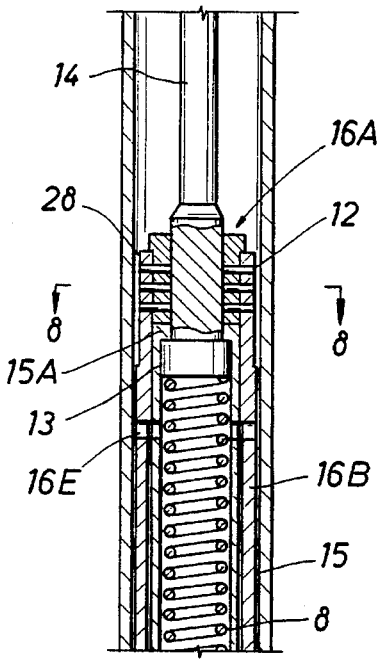
Figure 4:
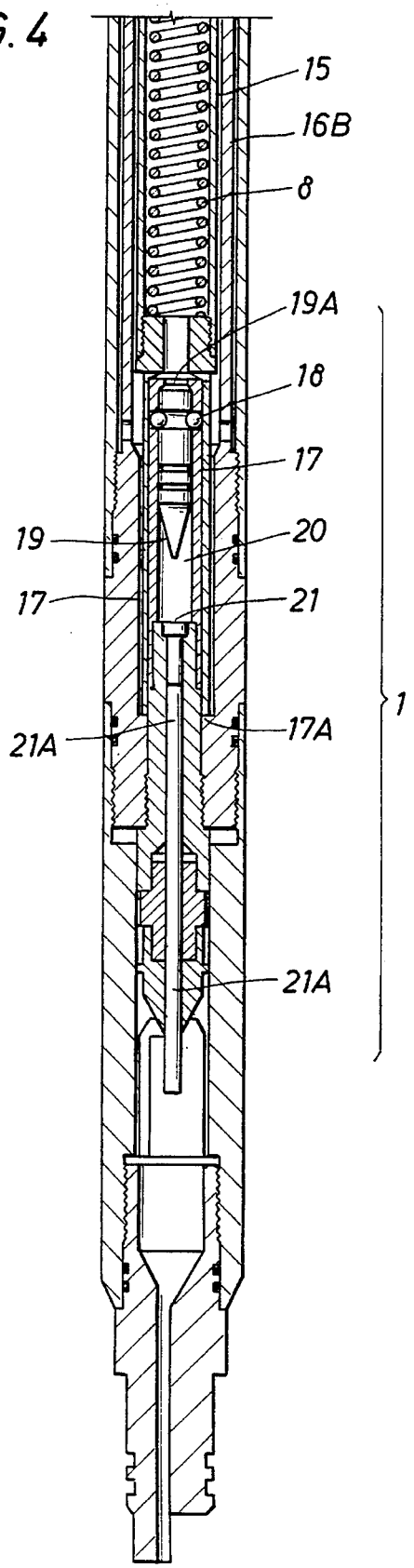
Figure 8:
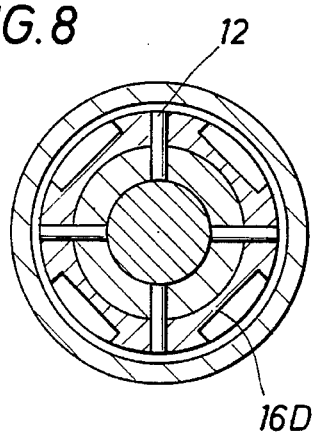

Referring to FIGS. 2 through 14, the Circulation Direction Firing Head (CDF firing head) E in accordance with one embodiment of the present invention is illustrated. FIGS. 2, 3, and 4 illustrate longitudinal cross sectional views of the CDF firing head taken along section lines 2—2 of FIG. 6. FIG. 5 illustrates a cross section of the CDF firing head taken along section lines 5—5 of FIG. 2. FIG. 6 illustrates a cross section of the CDF firing head taken along section lines 6—6 of FIG. 2. FIG. 7 illustrates a cross section of the CDF firing head taken along section lines 7—7 of FIG. 2. FIG. 8 illustrates a cross section of the CDF firing head taken along section lines 8—8 of FIG. 3. FIGS. 9–14 illustrate, for purposes of a functional description, the longitudinal cross sectional views of the CDF firing head in various stages of its functional operation.

In FIGS. 2, 3, and 4, the coiled tubing D of FIGS. 1*a* and 1*b* as shown in FIG. 2 is connected to an upper adaptor 11. The upper adaptor 11 is connected to a fluid inversion section 2 of the CDF firing head via a plurality of slots 10 shown in FIGS. 2 and 5. The fluid inversion section 2, situated above a firing section 1 shown in FIG. 4, provides a means of reverse circulating prior to firing the perforating guns C. The fluid inversion section 2 includes a plug 23 disposed adjacent the slots 10 and a connector housing 3 which further includes a double walled housing 3A and 3B. The connector housing 3 includes two sets of ports (ports 5 and 6) which are separated by a piston 4 thereby creating an artificial annulus 9. The piston 4 is adapted to move longitudinally within the connector housing 3 in response to a movement of a piston rod 14 until the piston 4 abuts against the plug 23. The top, first set of ports 5 fluidly communicate the rathole G of the wellbore B with the inside of the connector housing 3 on the top side of the piston 4. Below the piston 4, the second set of ports 6 fluidly connects the interior of the connector housing 3 to the artificial annulus 9. The artificial annulus 9 is further fluidly connected to the interior of the coiled tubing D. In FIGS. 2 and 3, the piston 4 is supported by a piston rod 14. In FIG. 3, downward movement of the piston 4 is resisted by a compression spring 8. The compression spring 8 urges the piston rod 14 upwardly in FIG. 3. The head 13 of the piston rod 14 disposed in abutment against the top 15A of a spring housing 15. In response to the upwardly directed biasing force of the spring 8, the head 13 of the piston rod 14 pushes upwardly against the top 15A of the spring housing 15 thereby tending to force the spring housing 15 upwardly in FIG. 3. When sufficient force is applied to the piston 4 whith coiled tubing pressure, the piston rod 14 will cause the inner sleeve 16A to break the shear pins 12 and will be sheared away from the outer shear set housing 16B, since the outer shear set housing 16B is a stationary piece. In FIG. 4, the lower end of the spring housing 15 is threadedly connected to a release sleeve 17. The release sleeve 17 holds four ball bearings 18 against a seat of a firing pin 19. As long as the release sleeve 17 holds the ball bearings 18 against the set of the firing pin 19, the firing pin 19 is firmly held in an elevated position relative to a booster 21 of a detonating cord 21A. The detonating cord 21A is connected between the booster 21 and a plurality of shaped charges disposed within the perforating gun C shown in FIGS. 1*a* and 1*b*.

A functional description of the operation of the Circulation Direction Firing (CDF) firing head E of FIGS. 2 through 4 will be set forth in the following paragraphs with reference to FIGS. 9 through 14 of the drawings.

Figures 9, 10:
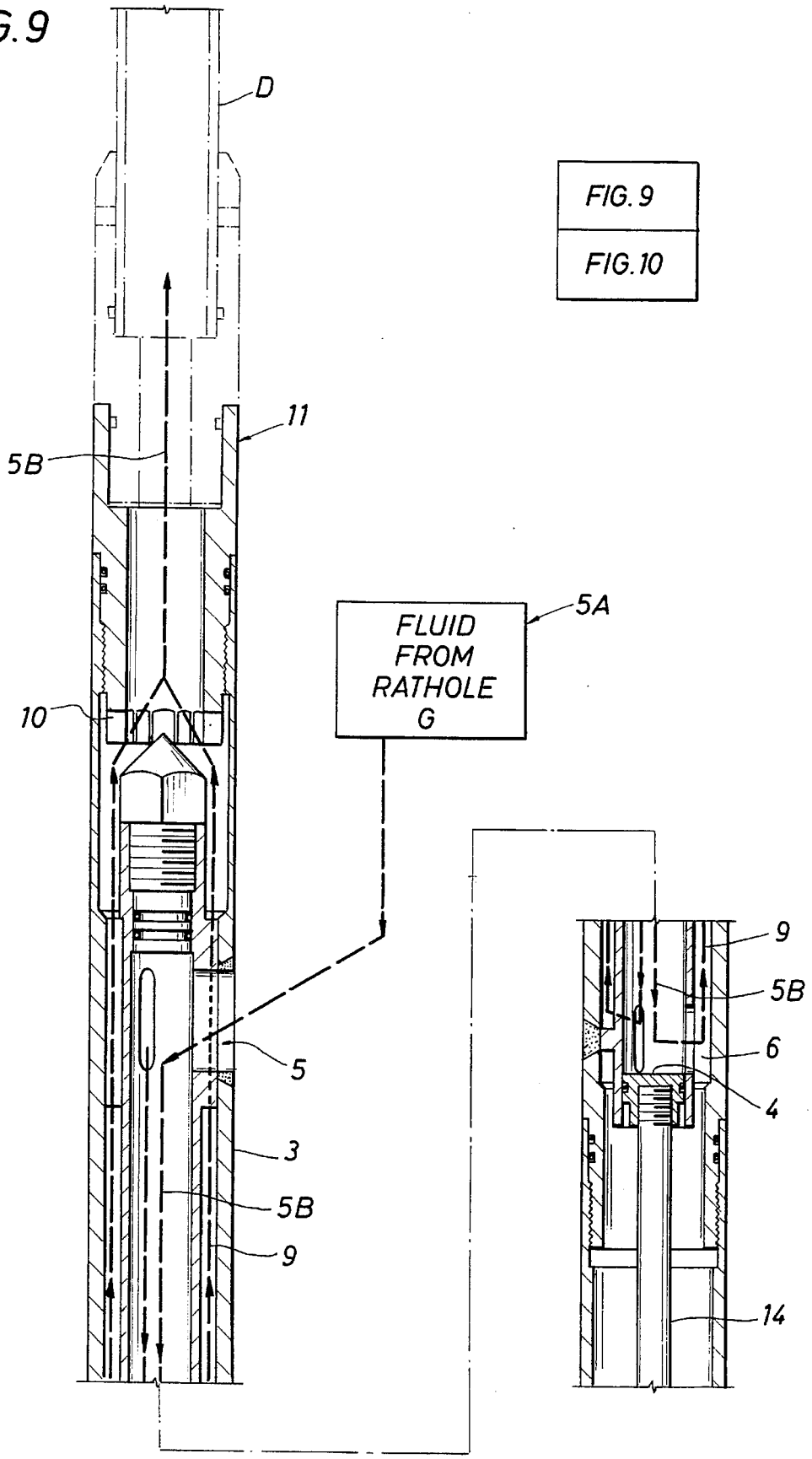
Figure 10:
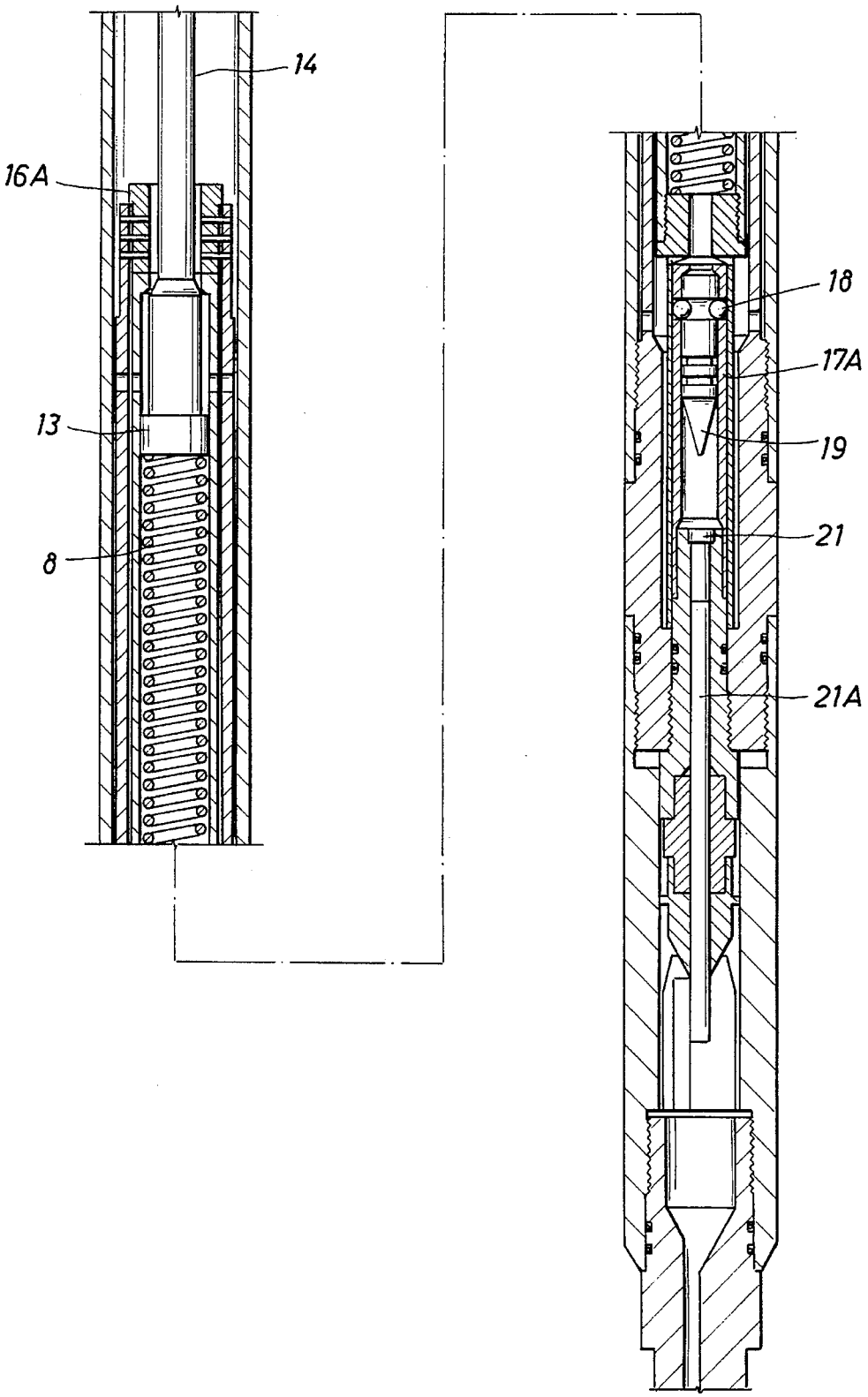

In FIG. 9–10, the CDF firing head E will first undergo reverse circulation whereby wellbore fluid will enter the coiled tubing D prior to detonating the CDF firing head. When reverse circulation of the CDF firing head E begins, as shown by the arrow 5B, a fluid under pressure, originating from the rathole G, will enter the upper set of ports 5, propagate down the center of the connector housing 3, and will be exerted against the piston 4. The fluid pressure from the rathole G moves the piston 4 downwardly against the biasing force of the spring 8 until the piston 4 is situated below the lower set of ports 6. When the piston 4 is situated below the lower set of ports 6, as shown in FIG. 9, fluid 5A from the rathole G will then enter the tool through the upper set of ports 5. The fluid 5A will continue to propagate downwardly through the interior of the connector housing 3 and will propagate outward through ports 6 before passing upwardly through the artificial annulus 9 disposed between the double walls 3A and 3B of the connector housing 3. As shown by arrow 5B, the fluid 5A will enter the interior of the coiled tubing D by passing through the slots 10 on the lower end of upper adapter 11. When the reverse circulation stops, the spring 8 will return the piston 4 to a neutral position which is located between the upper and lower set of ports 5 and 6.

Referring to FIGS. 11 through 14, now that wellbore fluid has been circulated through the CDF firing head E and into the coiled tubing D, the coiled tubing D is full of wellbore fluid and the CDF firing head E is now ready to be detonated.

Figures 11, 12:
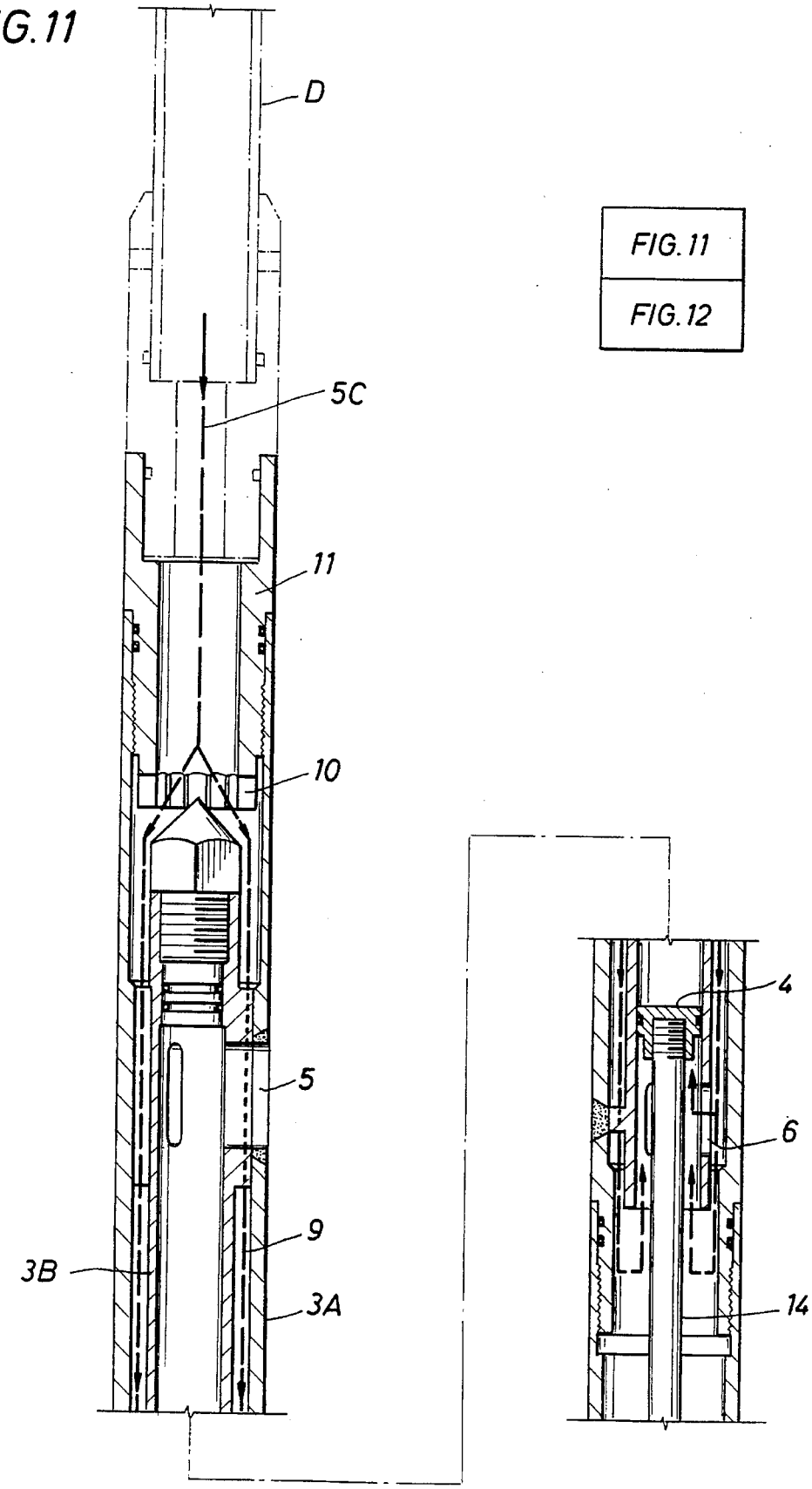
Figure 12:
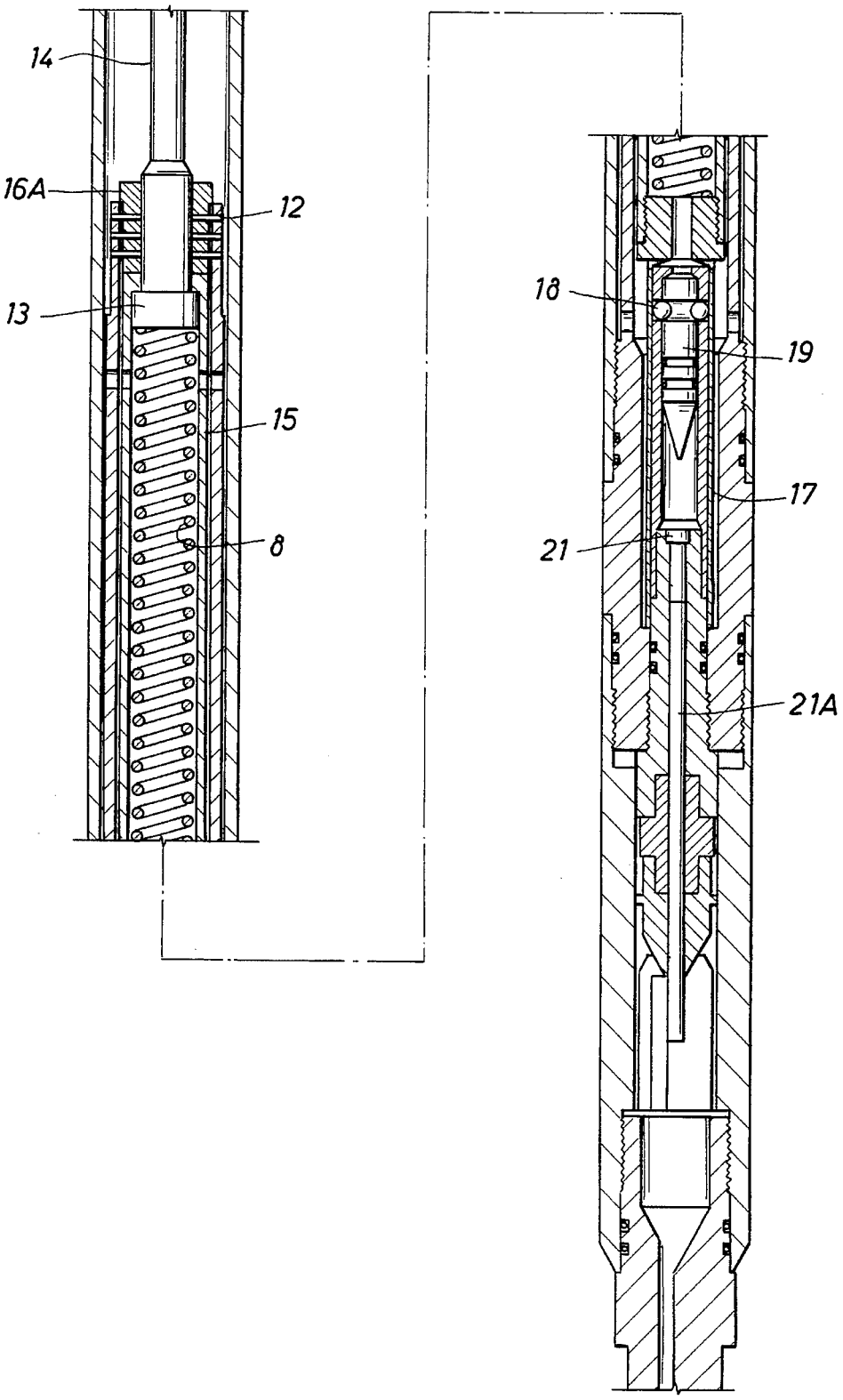

In FIGS. 11 through 12, in order to detonate the CDF firing head E, pressure is applied against the top side of the fluid disposed in the coiled tubing D. As a result, as shown by the arrow 5C in FIG. 11, the fluid, disposed in the coiled tubing D, is pumped through the coiled tubing and is ultimately applied against a bottom side of the piston 4 thereby moving the piston 4 upwardly in FIG. 11. More particularly, as shown by arrow 5C, the fluid moves from the interior of the coiled tubing D in FIG. 11, through the slots 10 on the lower end of the upper adapter 11, into the artificial annulus space 9 between the double walls 3A and 3B of the connector housing 3, inward through the lower set of ports 6, and reversing direction to act upward on the lower side of the piston 4. The pressure from the fluid is exerted against the lower side of the piston 4. As a result, the piston 4 tends to move upwardly. However, upward movement of the piston 4 is resisted by the shear pins 12 in FIG. 12. The shear pins 12 are loaded by the head 13 of the piston rod 14, the head 13 pushing upwardly on the spring housing 15 in FIG. 12 which, in turn, pushes upwardly on the inner sleeve 16A of the shear set.

Figure 13:
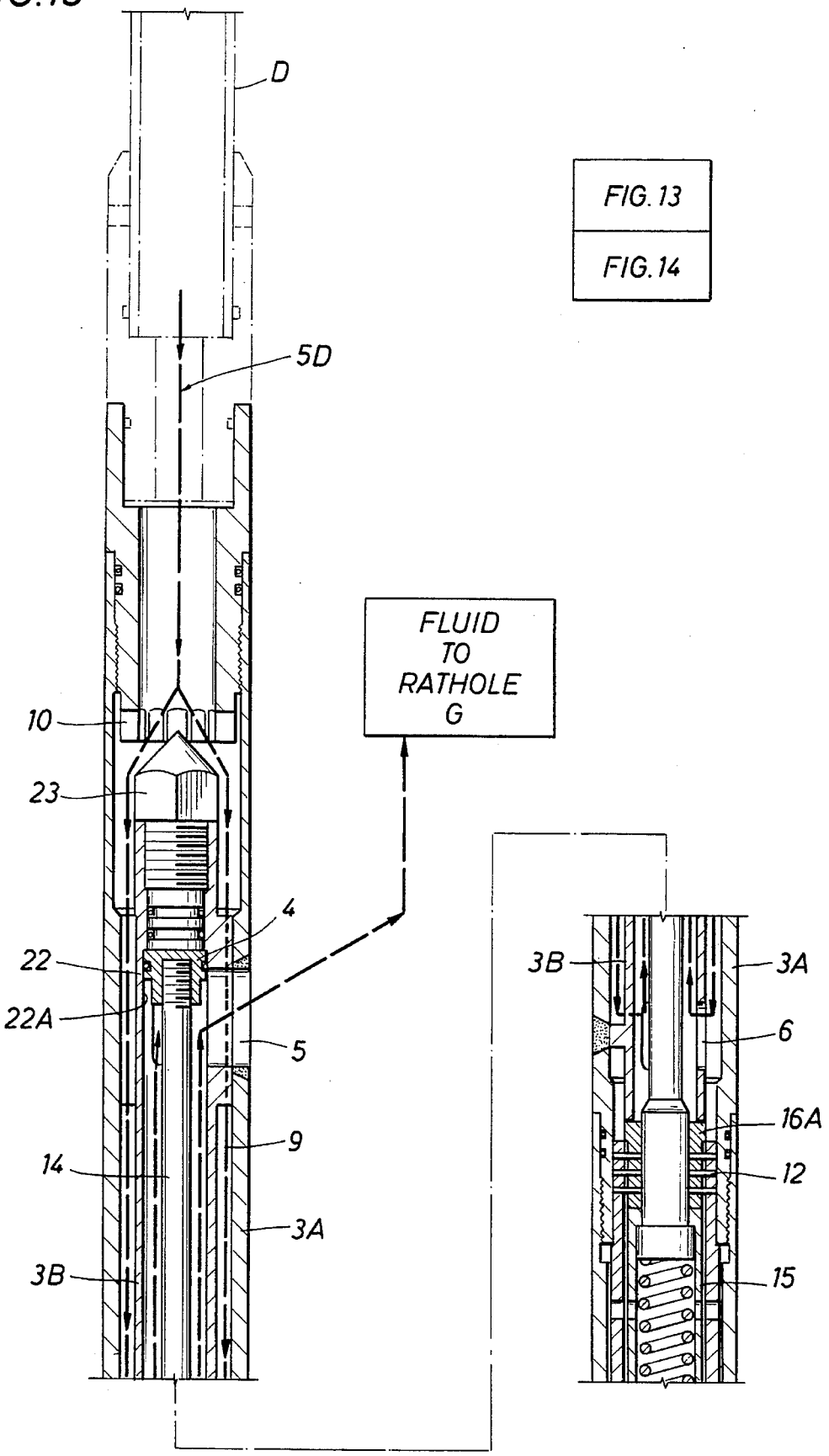
Figure 14:
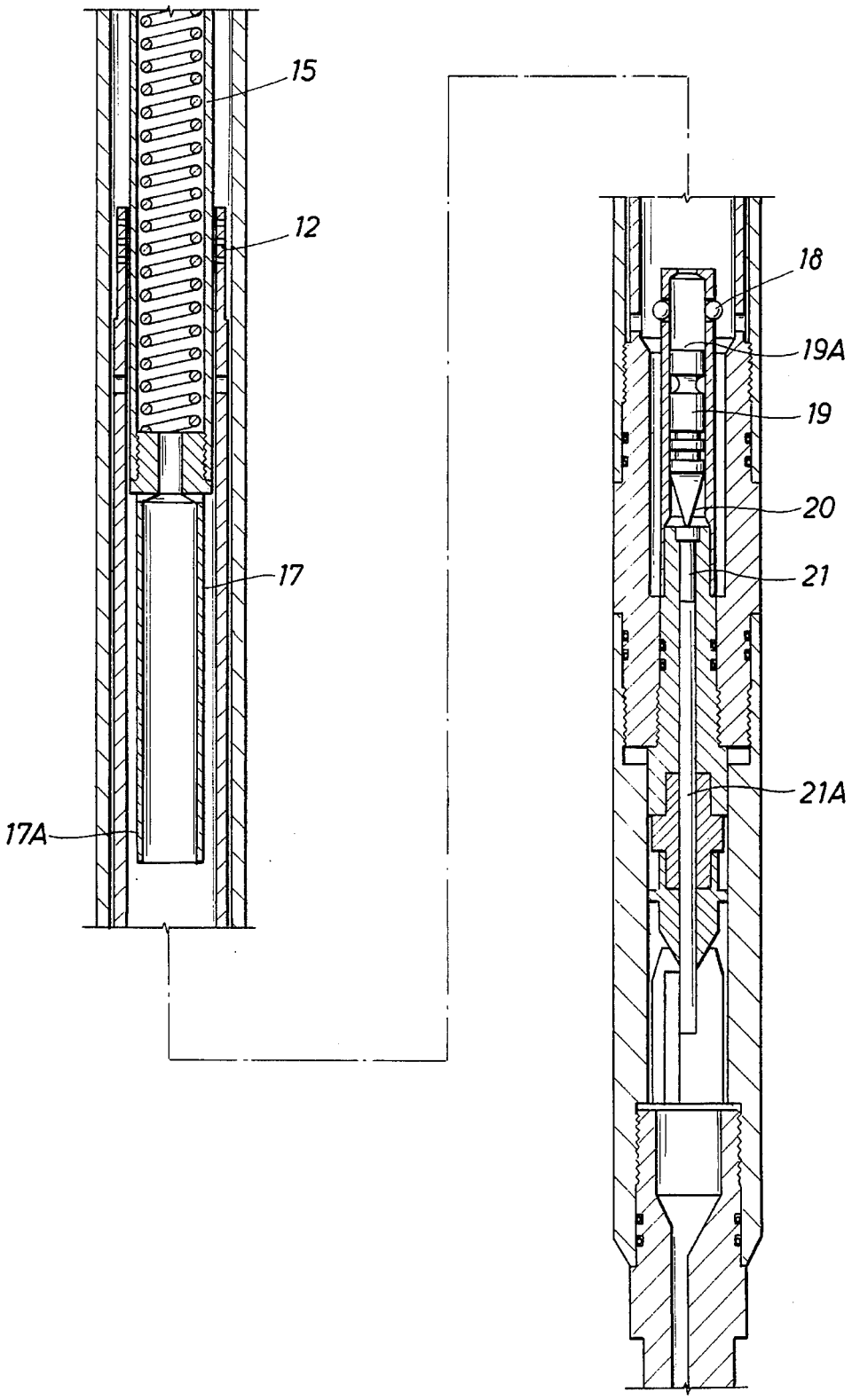

In FIG. 13 through 14, when sufficient fluid pressure is applied to shear the shear pins 12 via the fluid pressure exerted against the piston 4 originating from the coiled tubing D, the piston 4, piston rod 14, shear set inner sleeve 16A, spring housing 15 and release sleeve 17 all move upward. When the lower end 17A of the release sleeve 17 passes the ball bearings 18, the balls 18 pop out, releasing the firing pin 19. The firing pin 19 strikes the booster 21 of the detonating cord 21A to initiate the perforating gun C. Initiation of the CDF firing head E is accomplished by tubing pressure which acts on the top 19A of the firing pin 19 against the atmospheric chamber 20 causing the firing pin 19 to move downward striking the percussion detonator 21, initiating a firing train through the perforating gun C. The piston 4, piston rod 14, shear set inner sleeve 16A, spring housing 15 and release sleeve 17 all continue to move upward, until the piston 4 is above the upper ports 5, now allowing further fluid circulation. As shown by the arrow 5D in FIG. 13, the further fluid circulation is accomplished by pumping fluid through the coiled tubing D causing the fluid to move from the interior of the coiled tubing D, through the slots 10 on the lower end of the upper adapter 11, into the artificial annulus space 9, between the double walls 3A and 3B of the connector housing 3, through the lower set of ports 6, reversing direction to act upward on the lower side of the piston 4 until the piston is moved upward against the plug 23. The fluid exits the CDF firing head E by moving from the lower side of the piston 4 and out to the rathole G via the upper set of ports 5.

Just prior to reaching the plug 23, the piston 4 moves into an enlarged diameter 22 of the inner tube 22A of the connector housing 3, the enlarged diameter 22 equalizing the pressure across the piston 4. When the pumping of the fluid from the coiled tubing D and out to the rathole G via the upper ports 5 stops, the following parts of the CDF firing head should remain in fixed in position since there is no differential pressure across the piston 4: the piston 4, piston rod 14, shear set inner sleeve 16A, spring housing 15 and release sleeve 17. Since the above parts remain fixed in position, reverse fluid circulation may be performed when desired. If the above parts drop downward inside the CDF firing head, below the upper set of ports 5, the spring 8 will compress, allowing reverse circulation. If pumping through the coiled tubing D is resumed, with the above parts in the downward position, the above parts will again move upward in the manner described above.

Therefore, before the CDF firing head E is detonated, the piston 4 is disposed in its neutral position between ports 5 and 6. As a result, the CDF firing head of FIGS. 2–14 will allow for reverse fluid circulation from the rathole G through the ports 5 and toward the coiled tubing D, which is possible by moving the piston downward with rathole pressure. However, after the CDF firing head E is detonated, the piston 4 is disposed in its uppermost upwardly disposed position. As a result, the CDF firing head E of FIGS. 2–14 will allow for fluid circulation from the coiled tubing D and out the ports 5 to the rathole G, or reverse circulation from the rathole inward through ports 5 and up the coiled tubing.

Referring to FIGS. 15 through 25, the Circulation Ball Firing Head (CBF firing head) E in accordance with another embodiment of the present invention is illustrated.

FIGS. 15 and 16 illustrate a longitudinal cross section taken along section lines 15—15 of FIG. 18 illustrating the physical construction of the CBF firing head. FIG. 17 is a cross section of the CBF firing head E taken along section lines 17—17 of FIG. 15. FIG. 18 is a cross section of the CBF firing head E taken along section lines 18—18 of FIG. 15. FIG. 19 is a cross section of the CBF firing head E taken along section lines 19—19 of FIG. 15. FIG. 20 is a cross section of the CBF firing head E taken along section lines 20—20 of FIG. 16. FIGS. 21 through 25 illustrate, for purposes of a functional description, longitudinal cross sectional views of the CBF firing head in various stages of its functional operation.

Parts of the CBF firing head E of FIGS. 15–25 which are identical to other parts of the CDF firing head E of FIGS. 2–14 are identified by the same element numerals.

In FIGS. 15 and 16, unlike the CDF firing head of FIGS. 2–14, the CBF firing head of FIGS. 15–25 allows for fluid circulation in either direction both prior to and after firing the perforating gun C provided there are no back pressure valves disposed above the CBF firing head E in the perforating gun string of FIGS. 1*a* and 1*b*. In FIG. 15, the CBF firing head E includes an upper adaptor 11 connected to the coiled tubing D, the upper adaptor 11 including slots 10 disposed on its bottom end similar to the slots 10 shown in FIG. 2. A ball seat 24 is situated directly below the slots 10, the ball seat 24 having a seating surface 24A which is adapted to receive a ball 40 dropped from the wellbore surface and falling or pumped through the coiled tubing D. The set of upper ports 5 are disposed through the double walls 3A and 3B of the connector housing 3 similar to the upper ports 5 disposed through the double walls of the connector housing 3 in FIG. 2. A piston 4 is sealingly disposed within and connected to the inner wall 3B of the double wall connector housing 3 similar to the piston 4 in FIG. 2. The lower set of ports 6 are disposed below the piston 4 in FIG. 15, the lower set of ports 6 communicating the interior of the connector housing 3 with an artifical annulus area 9 disposed between the inner wall 3B and the outer wall 3A of the connector housing 3, similar to that which is shown in FIGS. 2–4. One end of a CBF piston rod 26 supports the piston 4. In addition, the other end of the piston rod 26 is threadedly connected to a release sleeve 27, the release sleeve 27 having a lower end 27A. The release sleeve 27 holds a pair of ball bearings 18 firmly against a groove in a firing pin 19. As long as the release sleeve 27 holds the ball bearings 18 against the groove in the firing pin 19, the pin 19 cannot move downwardly and impact a booster 21 of a detonating cord 21A. The detonating cord 21A is ultimately connected to a plurality of shaped charges in the perforating gun C of FIGS. 1*a* and 1*b*.

A functional description of the operation of the CBF firing head E of FIGS. 15–25 will be set forth in the following paragraphs with reference to FIGS. 21 through 25.

Figure 21:
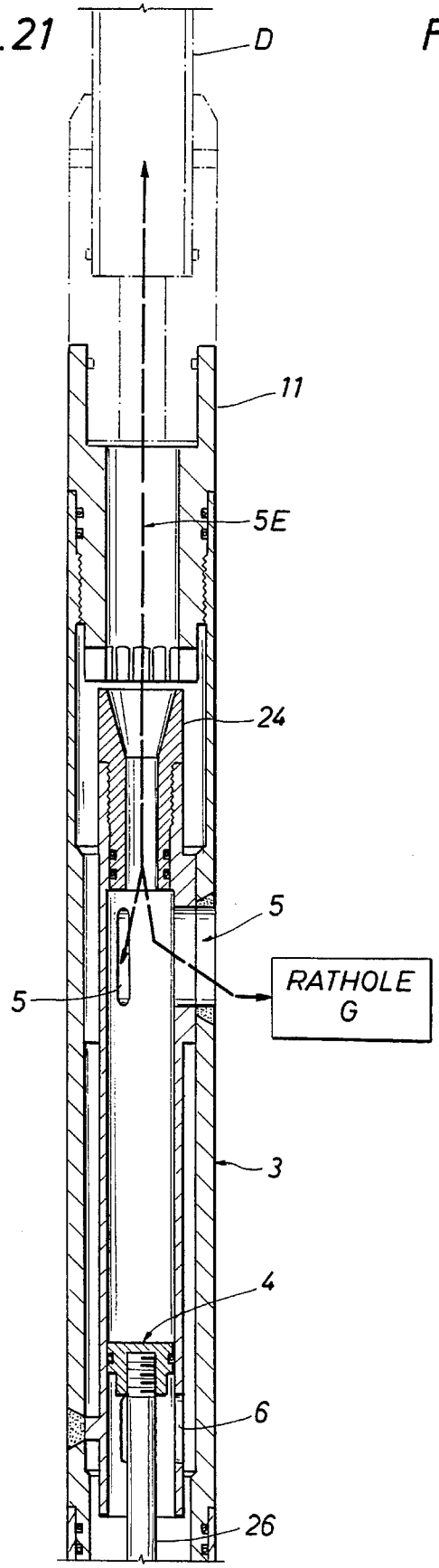

Before the ball 40 lands on the ball seat 24, as shown by the arrow 5E in FIG. 21, fluid is pumped down the coiled tubing D and flows through the ball seat 24 at the top of the connector housing 3 and out the upper set of ports 5 in the connector housing 3 to the rathole G. Conversely, as long as there are no back pressure valves in the perforating gun string above the CBF firing head and the ball 40 is not seated on the ball seat 24, wellbore fluid can be reverse circulated from the rathole G, through the CBF firing head, and into the coiled tubing D, as shown in FIG. 21. During this reverse circulation of the wellbore fluid through the CBF firing head, fluid in the rathole G enters the CBF firing head through the upper ports 5, passes into the interior of the connector housing 3, and flows upward through the interior of the ball seat 24 and upper adapter 11 and into the interior of the coiled tubing D.

Figure 22:
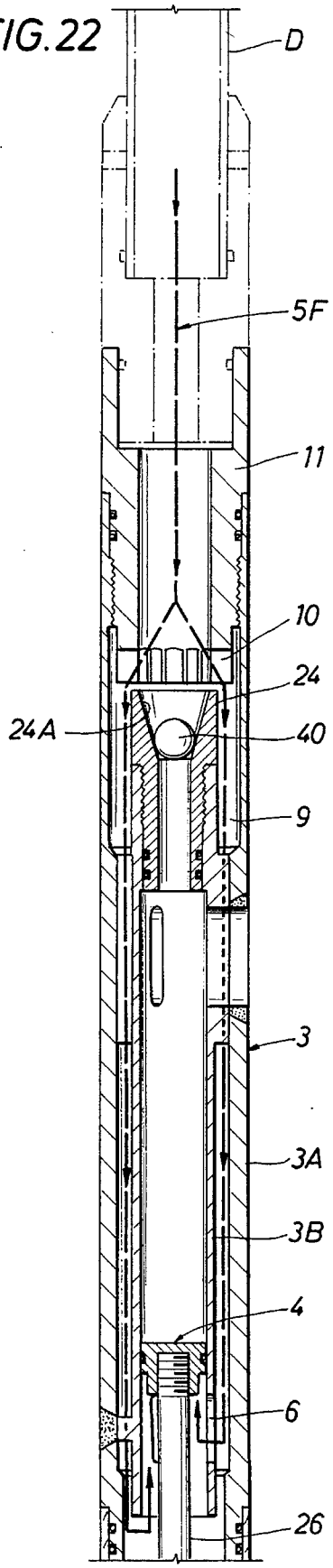

In FIG. 22, when the CBF firing head E of FIGS. 15–25 is ready to fire, a ball 40 is pumped through the coiled tubing D and lands and seals on the seating surface 24A of the ball seat 24. With the ball 40 seated on the seating surface 24A of the ball seat 24, as shown by the arrow 5F in FIG. 22, fluid moves from the interior of the coiled tubing D through the slots 10 on the lower end of the upper adapter 11, into the artificial annulus space 9 between the double walls 3A and 3B of the connector housing 3, through the lower set of ports 6, reversing direction to act upward on the lower side of the piston 4. The slots 10 in the upper adapter 11 are necessary to help guide the ball 40 to the seat and to prevent small diameter balls from becoming lodged between the lower end of the upper adapter 11 and the top of the ball seat 24 while maintaining adequate flow area between the upper adapter 11 and the ball seat 24. As shown in FIG. 16, upward movement of the piston 4 is resisted by the shear pins 12. The shear pins 12 are loaded by the head 25 of the CBF piston rod 26 which is pushing upward on the inner sleeve 16A of the shear set.

Figure 23:
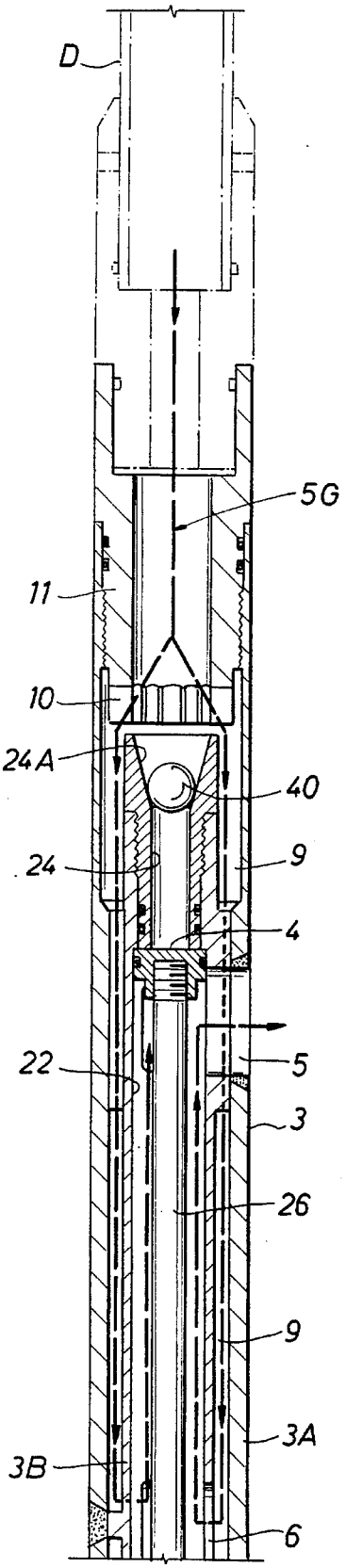
Figure 24:
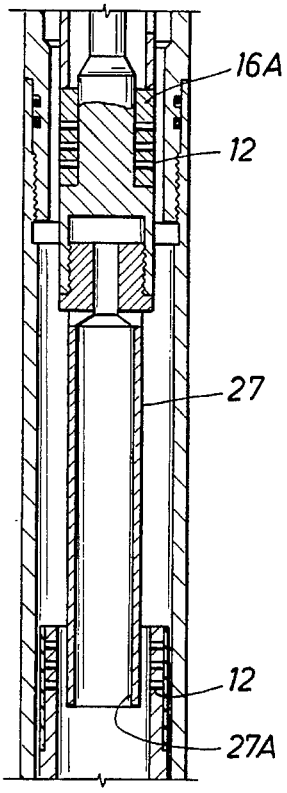
Figure 25:
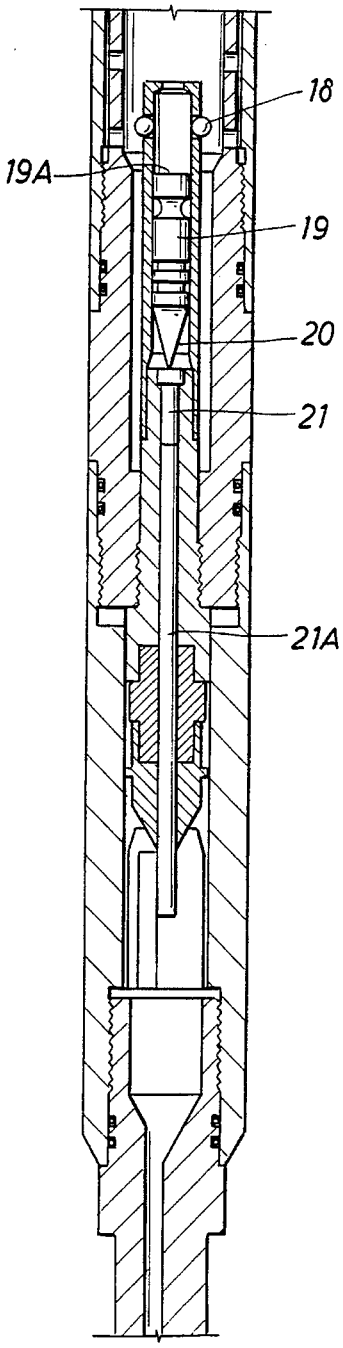

In FIGS. 23–25, when sufficient pressure is applied through the coiled tubing D to shear the shear pins 12, the piston 4, piston rod 26, shear set inner sleeve 16A, and release sleeve 27 all move upward. When the lower end 27A of the release sleeve 27 passes the ball bearings 18, the balls pop out, releasing the firing pin 19 to initiate the perforating gun C of FIGS. 1*a* and 1*b*. Initiation of the CBF firing head E of FIGS. 15–25 is accomplished by in response to a tubing pressure acting on the top 19A of the firing pin 19 against atmospheric chamber 20 thereby causing the firing pin 19 to move downward striking the percussion detonator 21, initiating the firing train through the detonating cord 21A and toward the perforating gun C. The piston 4, piston rod 26, shear set inner sleeve 16A, and release sleeve 27 all continue to move upward until the piston 4 is situated above the upper ports 5. When the piston 4 is situated above the upper ports 5, circulation is allowed. As shown by the arrow 5G in FIG. 23, circulation is accomplished by pumping through the coiled tubing D, as shown in FIG. 23, whereby the fluid moves from the interior of the coiled tubing D, through the slots 10 on the lower end of the upper adapter 11, into the artificial annulus 9 located between the double walls 3A and 3B of the connector housing 3, through the lower set of ports 6, reversing direction to act upward on the lower side of the piston 4 until the piston 4 is moved upward against the ball seat 24. Just prior to reaching the ball seat 24, the piston 4 moves into an enlarged diameter 22 of the inner tube of the connector housing 3, equalizing the pressure across the piston 4. When pumping ceases, the following CBF firing head parts should stay in place: the piston 4, piston rod 26, shear set inner sleeve 16A, and release sleeve 27. These parts should stay in place because there is no differential pressure across the piston 4, allowing reverse circulation when desired. If these parts drop downward in the CBF firing head, below the upper ports 5, the ball 40 can be pumped off its seat 24A, allowing reverse circulation. If pumping through the coiled tubing is resumed, with these parts in the downward position, these parts will move upward as described above.

There are other features which are common to both the CDF firing head of FIGS. 2–14 and the CBF firing head of FIGS. 15–25.

For example, although different shear set housings are used on the two tools, they are identical except for length. Both shear set housings 16B on the CDF and 16C on the CBF have vertical slots 16D (see FIG. 20) running from the top edge housing down to ports 16E (see FIG. 16) thus connecting the annular space between the lower housing 29 or 30 and the piston rod 14 or 26 to the ball release sleeve 17 or 27. These slots pass under the shear pin retainer sleeve 28 of FIG. 16 to assure an adequate supply of fluid to drive the firing pin 19 when it is released. The artificial annulus space 9 between the double walls of the connector housing 3 is isolated from rathole G by the piston 4. Upper ports 5 are sealed between the rathole G and the artificial annular space 9. The interior of coiled tubing D communicates directly with the artificial annulus space 9 via the slots 10 in the upper adapter 11. The only way that the interior of coiled tubing D and the rathole G can communicate is for the piston 4 to move below the lower ports 6 or above the upper ports 5, or through the ball seat 24 on a CBF firing head. Both the CDF firing head of FIGS. 2–14 and the CBF firing heads of FIGS. 15–25 are insensitive to mechanical shock from dropping, etc, since the release sleeve 27 moves upward to release the balls 18, but its lower end 27A is shouldered against the shear set housings 16B or 16C thereby preventing downward movement. Both the CDF and the CBF firing heads are insensitive to water hammer since the piston 4 must move upward after the pressure wave has been greatly reduced by making the tortuous path from the interior of the coiled tubing D through the slots 10 on the lower end of the upper adapter 11, into the artificial annular space 9 between the double walls of the connector housing 3, through the lower set of ports 6 reversing direction to act upward on the lower side of the piston 4. In addition, the movement of the piston 4 is resisted by the shear pins 12.

In summary, the following characteristics and advantages are common to both the CDF firing head of FIGS. 2–14 and the CBF firing head of FIGS. 15–25. The firing heads are insensitive to the absolute pressure around it. The CDF firing head permits reverse circulation through the firing head prior to firing and circulation in either direction after firing; however, the CBF firing head permits circulation in either direction prior to and after firing. Both firing heads include a means of reversing the direction of fluid flow to activate the firing head, that is, the fluid travels from the inside of the coiled tubing to an artificial annulus within the tool and reverses directions to act upward on an initiating device within the center of the head. Both firing heads, once activated, opens a passage from the coiled tubing D to the rathole for circulating fluids for the purpose of treating, stimulating or plugging a well. Both firing heads are water hammer insensitive and are drop insensitive.

Referring to FIGS. 26 through 39, the Ball Actuated Circulation Firing Head (BCF firing head) E in accordance with still another embodiment of the present invention is illustrated.

Figure 26:
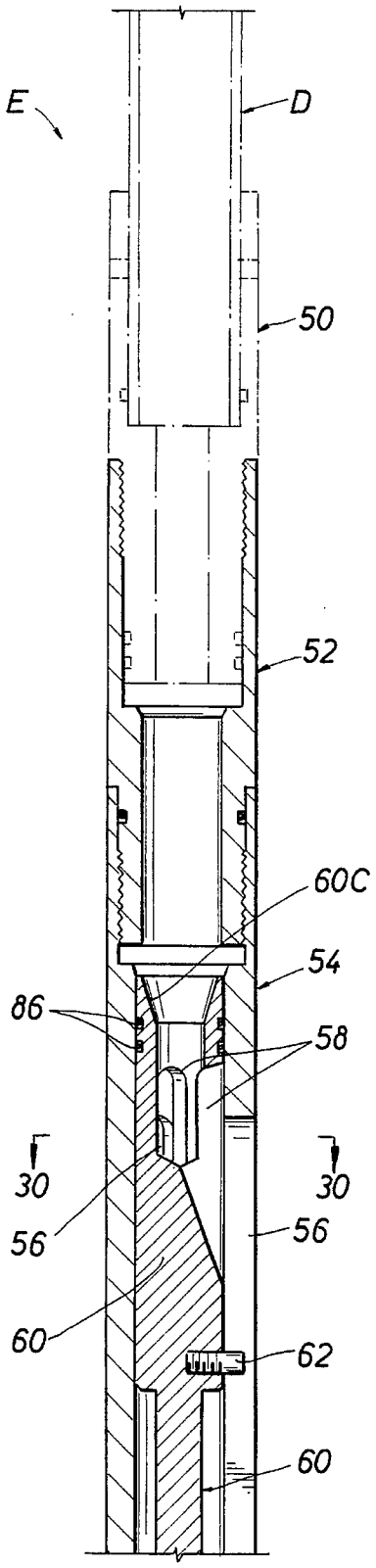
FIGS. 26 through 39 illustrate the Ball Actuated Circulation Firing Head (BCF firing head) in accordance with still another embodiment of the present invention.
Figure 26:
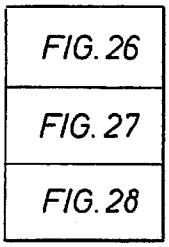
Figure 29:
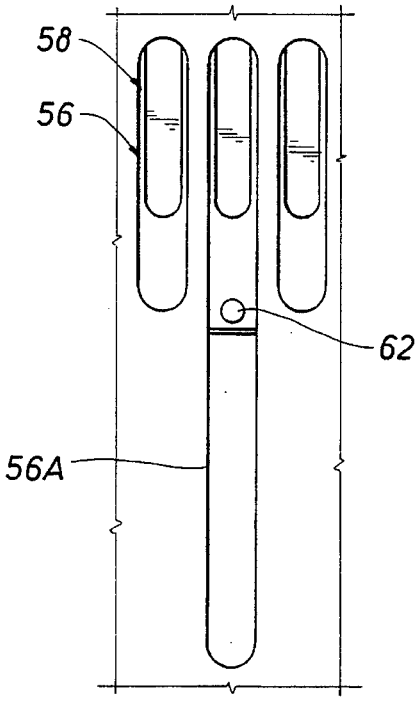
Figure 30:
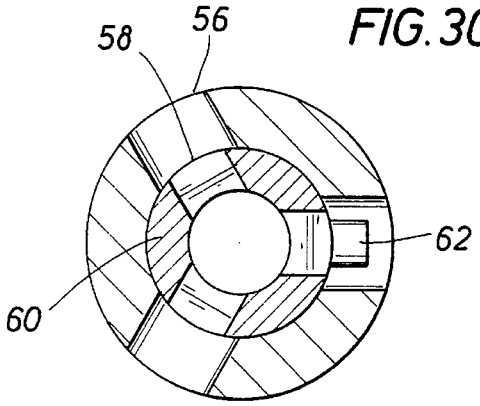
Figure 27:
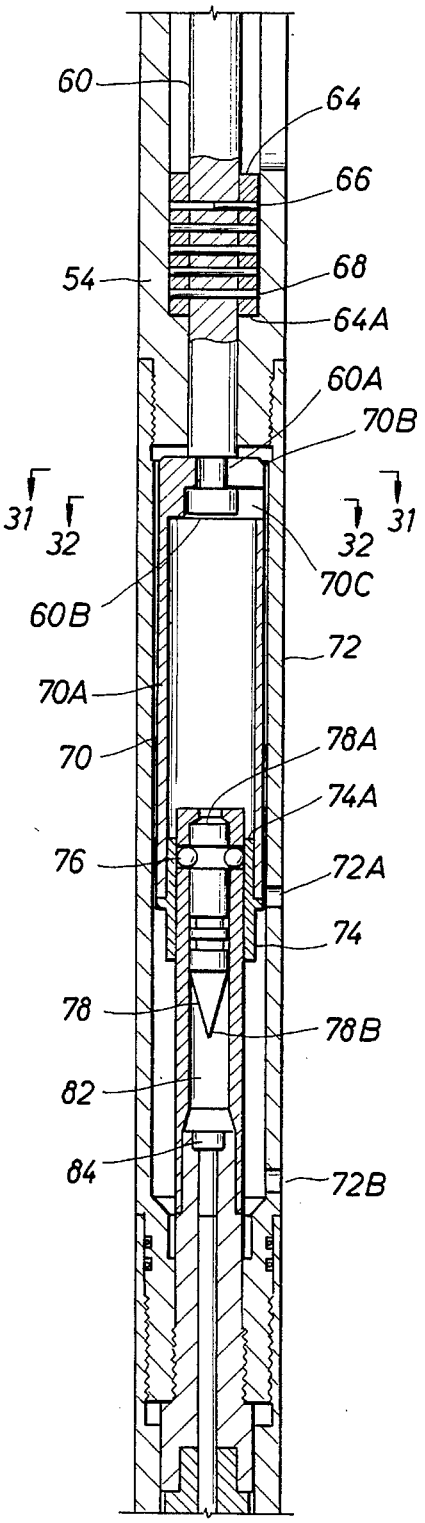
Figure 28:
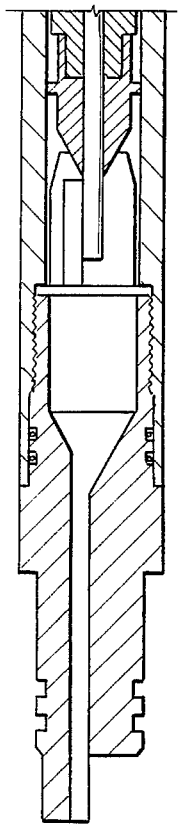
Figure 31:
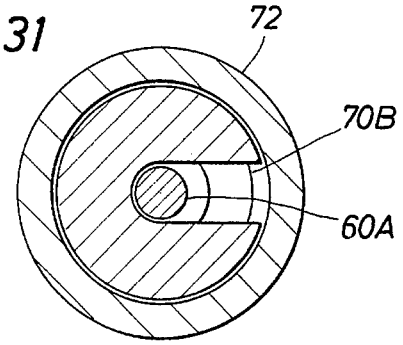
Figure 32:
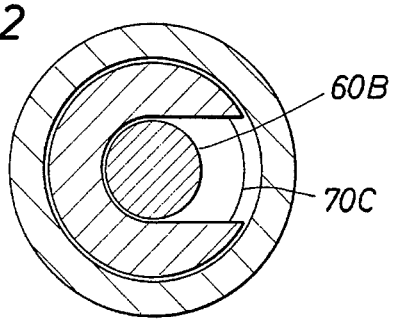
Figure 34:
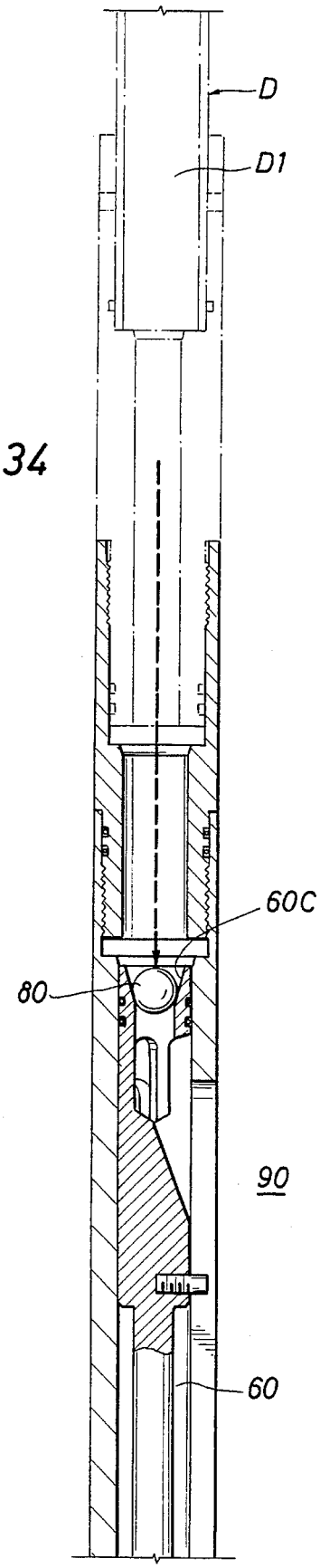
Figure 33:
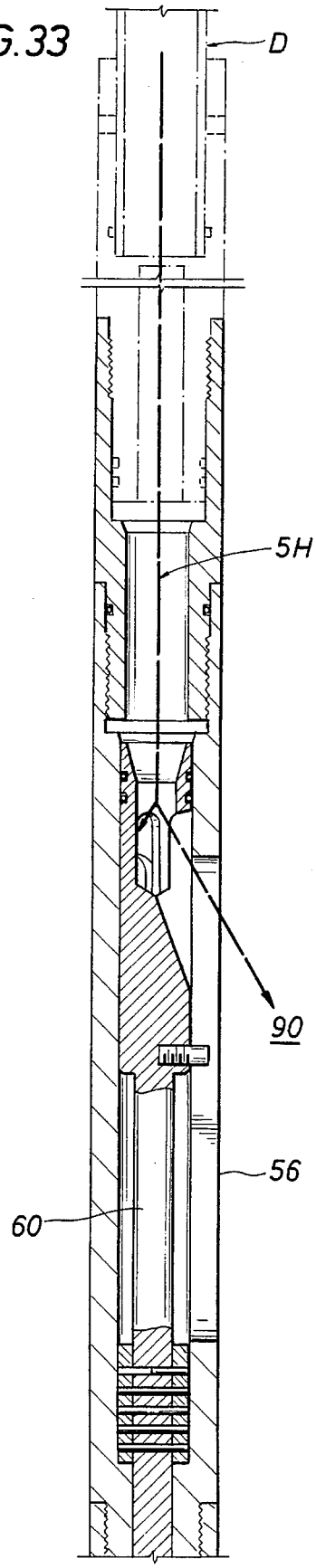
Figure 35:
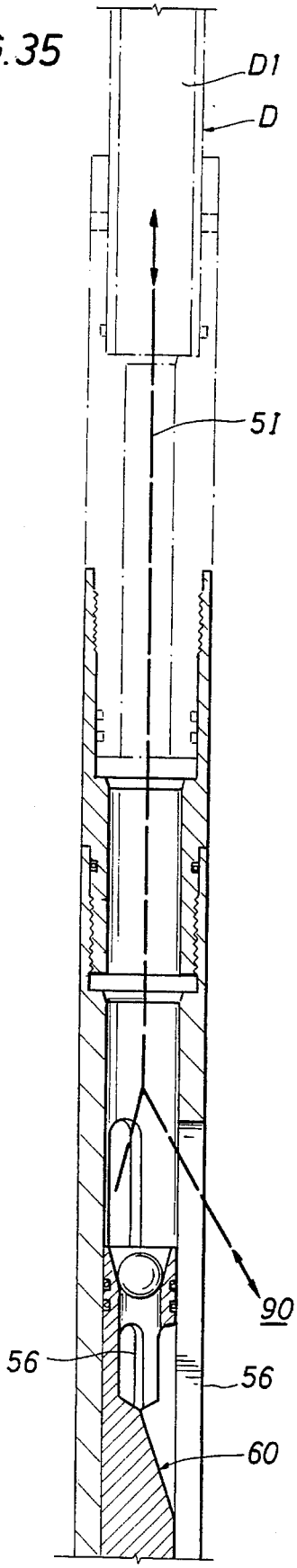
Figure 36:
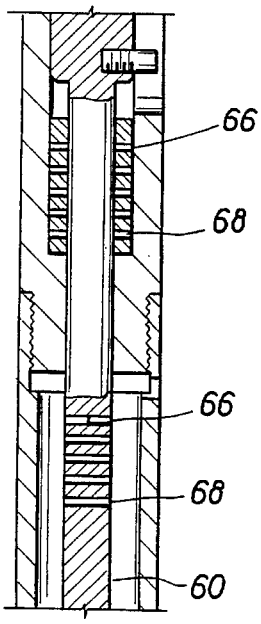
Figure 37:
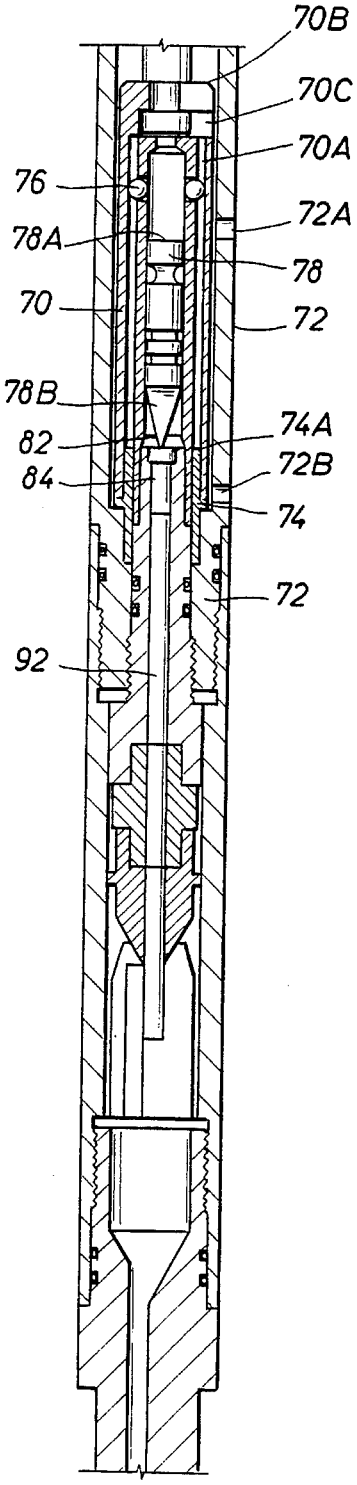
Figure 38:
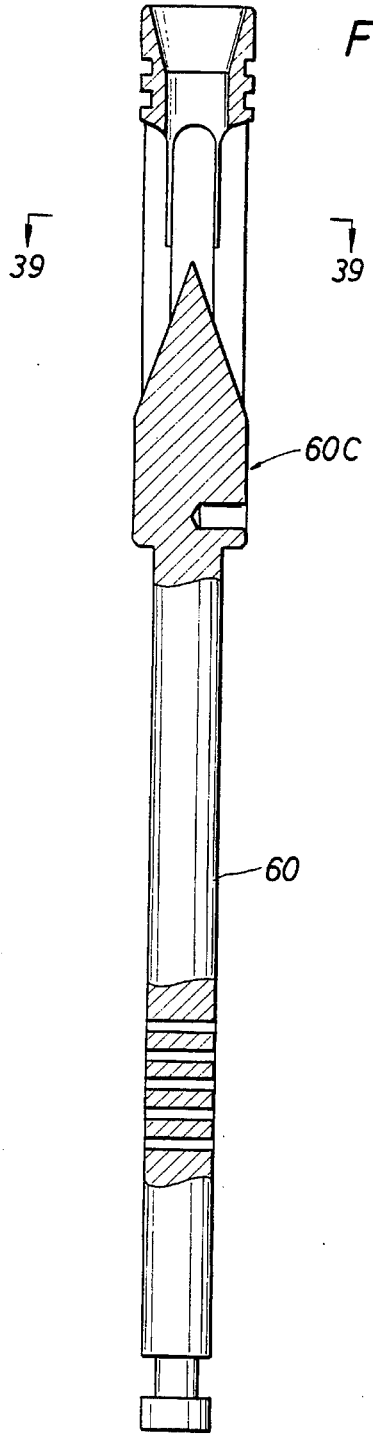
Figure 39:
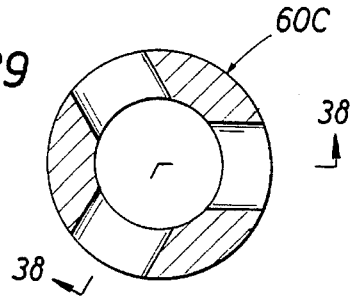

FIGS. 26 through 28 illustrate a physical construction of the BCF firing head E. FIG. 29 illustrates three longitudinal slots 56 in the piston housing 54 of FIG. 26. FIG. 30 illustrates a cross section of the BCF firing head E taken along section lines 30—30 of FIG. 26. FIG. 31 illustrates a cross section of the BCF firing head E taken along section lines 31—31 of FIG. 27. FIG. 32 illustrates a cross section of the BCF firing head E taken along section lines 32—32 of FIG. 27. FIGS. 33 and 34 illustrate, for purposes of a functional description, the portion of the BCF firing head E shown in FIG. 26. FIGS. 35 through 37 illustrate again, for purposes of a further functional description, the BCF firing head E of FIGS. 26–28. FIGS. 38–39 illustrate the piston 60 of FIGS. 26–27.

In FIGS. 26, 29, 30, 38, and 39, the BCF firing head E of FIG. 26 is normally run on the bottom end of a coiled tubing D and is connected to the coiled tubing D by the crossover adapter 50. A variety of upper adapters 52 are used to connect to various sizes of coiled tubing D. The piston housing 54 is connected to the bottom of the upper adapter 52. As best shown in FIG. 29 in conjunction with FIG. 26, a piston housing 54 contains three or more longitudinal slots 56, and, as shown in FIG. 30, a piston 60 disposed within the piston housing 54 contains a corresponding number of slots 58 which are congruent with the slots 56. As best seen in FIG. 29, slot 56A of the slots 56 in the piston housing 54 is elongated more than the other slots 56 in order to provide a means of aligning the slots 56 in the piston housing 54 with the slots 58 in the piston 60. A bolt 62 runs in the longest slot 56A of the piston housing 56 in order to maintain the congruent angular orientation of the the slots 58 in the piston 60 relative to the slots 56 in the piston housing 54. Fluid can pass freely from the interior of the coiled tubing D through the slots 58 and 56 to the annular space outside the BCF; and, if there are no back pressure valves in the tool string above the BCF, the fluid can move freely between the annular space outside the BCF firing head to the interior of the coiled tubing D. The effect of water hammer is reduced by the shape of the slots 58 in the piston 60. The slots 58 are milled at a very lean angle with the center line of the BCF so as to make a smooth transition from the interior of the BCF firing head to the annular space outside the BCF firing head. In addition, as best shown in FIGS. 38 and 39, with three or more slots, a pyramid is formed in the piston 60 that helps break up the effect of the water hammer. The position of the slots 56 in the piston housing 54 are such that the fluid should never touch the edges of the slots 56 since the slots 56 in the piston housing 54 are wider than the slots 58 in the piston 60. In addition, the slots 56 are maintained in alignment with the slots 58 by the bolt 62.

In FIGS. 27, 31, and 32, vertically, the piston 60 is positioned by shear pin sleeve 64 shouldering on the internal upset of the piston housing 54 at point 64A. Shear pins 66 and/or 68 lock the piston 60 to the shear pin sleeve 64. Shear value of the four headless shear pins 66 are approximately 1,000 psi per pin. Shear value of shear pin 68, which has a head, can be 250, 500 or 1,000 psi, thus a range of operating pressures from 250 to 5,000 can be achieved. Near the lower end of piston 60, there is a reduced diameter 60A and an enlargement 60B below the reduced diameter 60A. The top end of connector 70 has a small slot 70B milled in it that slips over the reduced diameter 60A of piston 60. Below the slot 70B, a larger slot 70C is large enough to slip over the enlarged diameter 60B on the bottom end of piston 60. The combination of diameters 60A and 60B plus slots 70B and 70C act together to attach a connector 70 to the piston 60. Once assembled, an intermediate housing 72 maintains the engagement of the connector 70 to the piston 60; and, as a result, the connector 70 moves with piston 60. Intermediate housing includes holes 72A and 72B. Ball retainer 74 having a top end 74A is threadably attached to the lower end of connector 70. The internal diameter of ball retainer 74 firmly holds the ball bearings 76 in place against a side of the firing pin 78 and thus maintains the firing pin 78 in a safe, elevated, running-in position.

A functional description of the BCF firing head E of FIGS. 26 through 32 will be set forth in the following paragraphs with reference to FIGS. 33 through 37 of the drawings.

In FIG. 33, as shown by the arrow 5H in FIG. 33, wellbore fluid can be circulated freely, in either direction, between the interior of coiled tubing D to an annulus space 90 outside the BCF firing head (where the annulus 90 is most often in the casing below the tubing string A in FIG. 1*b*), provided there are no back pressure valves in the tool string above the firing head. This is ideal for setting the underbalance during a Tubing Conveyed Perforating job, maintaining well control, or conditioning the well, prior to firing the BCF firing head E of FIGS. 26–39. The piston 60 is balanced while circulating the wellbore fluid in either direction because the piston 60: (1) is exposed to a pressure of fluid from the interior of the coiled tubing D, (2) is open to the annulus 90 through the slots 56 in the piston housing 54, and (3) as shown in FIG. 27, is open to the annulus 90 from below due to the holes 72A and 72B in the intermediate housing 72. Thus, there is no tendency for the BCF firing head to fire while circulating the wellbore fluid.

In FIG. 34, in order to initiate a detonation of the BCF firing head E of FIGS. 26–39, a ball 80 must be dropped or pumped through the coiled tubing D. The ball 80 will land on the ball seat 60C located in the upper end of piston 60. When the ball lands on the ball seat 60C, the ball 80 functions as a seal, isolating the interior D1 of the coiled tubing D from the annulus space 90 located outside the BCF firing head E of FIGS. 26–39.

In FIGS. 35 through 37, as shown by the arrow 5I in FIG. 35, fluid pressure from coiled tubing D is exerted on piston 60 creating a differential pressure between the interior D1 of the coiled tubing D and the annulus 90 located outside the BCF firing head. When the differential fluid pressure which exists between the interior D1 of the coiled tubing D and the annulus 90 located outside the BCF firing head of FIG. 35 is equal to the shear pin value total of all shear pins 66 through 68 of FIG. 36, the shear pins 66 through 68 shear off thereby freeing the piston 60, allowing the piston 60 to move downwardly. Downward movement of piston 60 causes connector 70 to move down, carrying ball retainer 74 with it. When the top end 74A of the ball retainer 74 moves below the ball bearings 76, firing pin 78 is released. Annular fluid pressure enters the inside of the connector 70 through the holes 72A and 72B in intermediate housing 72 and flows through the slots 70B and 70C. The annulus fluid pressure acts downward on the top 78A of firing pin 78 against an air chamber 82. The annular pressure, acting on the top 78A of firing pin 78 against the air chamber 82, causes the firing pin 78 to move rapidly downward, so that the lower end 78B of the firing pin 78 strikes the percussion detonator 84, initiating a firing train in a detonating cord 92. The detonating cord is connected to a plurality of shaped charges in the perforating gun C of FIGS. 1*a* and 1*b*. The bore 70A of the connector 70 provides space for the released balls 76. The balls 76 will not to interfere with the movement of the firing pin 78. Initiation of the BCF firing head E of FIGS. 35–37 is observed at the surface of the wellbore B by a decrease in tubing pressure caused by the O-rings 86 located on the upper end of piston 60 passing the slots 56 in piston housing 54. Inertia of the piston 60, once the shear pins 66 and 68 shear, causes the piston 60 to move downward until the ball retainer 74 shoulders against the intermediate housing 72. This uncovers the slots 56 in the piston housing 54 so that fluid circulation through the coiled tubing D to the annulus 90 can take place as shown in FIG. 35. Circulation from the annulus 90 to the coiled tubing D is also possible so long as there is no back pressure valves in the tool string above the BCF firing head.

In summary, the BCF firing head of FIGS. 26–39 is insensitive to the absolute pressure around it. The BCF firing head permits circulation through the firing head in either direction both before and after firing. The BCF firing head, once activated, opens a passage from the coiled tubing to the rathole for circulating fluids for the purpose of treating, stimulating or plugging a well. The BCF firing head is water hammer insensitive.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An apparatus adapted to be disposed in a wellbore, comprising: a coiled tubing having an interior; and a firing head connected to the coiled tubing adapted to be disposed in said wellbore, an annulus being located around said firing head when said firing head is disposed in said wellbore, said firing head including an end having a central bore and an outer housing, said coiled tubing being received in said central bore at said end of said firing head, said outer housing including a port adapted for circulating and reverse circulating a fluid through said firing head between said interior of said coiled tubing at said end of said firing head and said annulus around said firing head.

2. The apparatus of claim 1, further comprising:

a detonation device connected to the firing head, said firing head being connected between said coiled tubing and said detonation device.

3. The apparatus of claim 2, wherein said detonation device includes a perforating gun, said coiled tubing adapted to contain fluid under pressure, said firing head detonating said perforating gun in response to said fluid under pressure contained within said coiled tubing when said fluid in said annulus is reverse circulated from said annulus through said firing head and into said interior of said coiled tubing and said fluid in said interior of said coiled tubing at said end of said firing head is circulated from said interior of said coiled tubing through said firing head and into said annulus.

4. A method of detonating a firing head adapted to be disposed in a wellbore, an annulus existing around said firing head when said firing head is disposed in said wellbore, said firing head including an end having a central bore and an outer housing, a coiled tubing adapted to be received into said central bore at said end of said firing head, said outer housing including a port adapted for circulating and reverse circulating a fluid through said firing head between an interior of said coiled tubing at said end of said firing head when said coiled tubing is received into said central bore and said annulus around said firing head, comprising the steps of:

(a) when said coiled tubing is received into said central bore at said end of said firing head, circulating said fluid from the interior of said coiled tubing into said central bore, through said firing head, through said port, and into said annulus; and (b) detonating said firing head in response to the circulating step (a).

5. The method of claim 4, wherein said firing head includes a piston disposed within said outer housing adapted for moving and detonating said firing head, said central bore fluidly communicating said fluid in said interior of said coiled tubing between said coiled tubing and an interior of said firing head, and wherein the circulating step (a) further comprises the steps of:

(c) when said coiled tubing is received into said central bore at said end of said firing head, circulating said fluid from said interior of said coiled tubing, into said central bore, through said interior of said firing head, and toward said piston moving said piston past said port, through said port, and into said annulus.

6. The method of claim 5, wherein the circulating step (c) comprises the steps of:

(d) when said coiled tubing is received into said central bore at said end of said firing head, reverse circulating said fluid from said annulus through said port, through said interior of said firing head, through said central bore, and into said interior of said coiled tubing; and (e) following the reverse circulating step (d), circulating said fluid from said interior of said coiled tubing, through said central bore, through said interior of said firing head, and toward said piston moving said piston past said port, through said port, and into said annulus, said firing head being detonated in response to the circulating step (e).

7. A method of operating a firing head adapted to be connected to a coiled tubing in a wellbore, a fluid adapted to be disposed within an interior of said coiled tubing, comprising the steps of:

(a) moving said fluid from the interior of said coiled tubing into said firing head when said coiled tubing is connected to said firing head in said wellbore and said fluid is disposed within the interior of said coiled tubing, said firing head including an outer housing defining a central bore adapted to interconnect said coiled tubing to said firing head, a piston disposed within said outer housing adapted for moving and detonating said firing head, said central bore fluidly communicating said fluid in said interior of said coiled tubing between said coiled tubing and an interior of said firing head, and a port disposed through said outer housing adapted for fluidly communicating an external annulus with said interior of said firing head; and (b) detonating said firing head in response to the moving step (a), the detonating step (b) including the steps of, (b1) reverse circulating a fluid between said external annulus and said interior of said coiled tubing via said port, said interior of said firing head, and said central bore, and circulating said fluid from said interior of said coiled tubing, through said central bore, through said interior of said firing head, and toward said piston, (b2) moving said piston in response to the circulating step (b1), and (b3) detonating said firing head in response to said moving step (b2); and (c) continuing the step of circulating said fluid in step (b1) by circulating said fluid from said interior of said firing head, through said port, and into said external annulus.

8. The method of claim 7, wherein the detonating step (b3) further comprises the steps of:

moving a release sleeve in response to the moving step (b2);

propelling a firing pin in response to the movement of said release sleeve; and detonating said firing head in response to the propelling step.

9. An apparatus adapted to be lowered into a tubing string in a wellbore, comprising:

a coiled tubing adapted to contain a fluid under pressure;

a firing head connected to said coiled tubing and adapted to detonate, said firing head detonating in response to the pressure of said fluid when said fluid is contained within said coiled tubing; and a detonation device connected to said firing head, said firing head including firing means for moving from a first position to a second position and detonating said detonation device when said firing means is disposed in said second position, holding means for holding said firing means in said first position, and release means responsive to said pressure of said fluid in said coiled tubing for releasing said holding means and allowing said firing means to move from said first position to said second position, said firing means detonating said detonation device when said firing means is moved to said second position, said release means including piston means responsive to said pressure of said fluid in said coiled tubing for moving in response to said pressure, a piston rod connected to said piston means and moving in response to a movement of said piston means, and a release sleeve connected between said piston rod and said holding means for releasing said holding means and allowing said firing means to move to said second position when said piston rod moves in response to the movement of said piston means, said firing means including a firing pin, said holding means including a ball bearing for holding said firing pin in said first position, said release sleeve releasing said ball bearing, said ball bearing releasing said firing pin when said release sleeve releases said ball bearing, said firing pin detonating said detonation device when said firing pin is released.

10. An apparatus adapted to be lowered into a tubing string in a wellbore, an annulus space existing around said apparatus when said apparatus is lowered into said tubing string in said wellbore, a fluid being disposed within said annulus space, comprising:

a coiled tubing adapted to contain a fluid under pressure;

a firing head adapted to detonate and connected to the coiled tubing, said firing head detonating in response to the pressure of said fluid when said fluid under pressure is contained within said coiled tubing; and a detonation device connected to said firing head, said firing head being connected between said coiled tubing and said detonation device, said firing head including, firing means for moving from a first position to a second position and detonating said detonation device when said firing means is disposed in said second position, holding means for holding said firing means in said first position, release means responsive to said pressure of said fluid in said coiled tubing for releasing said holding means and allowing said firing means to move from said first position to said second position, said firing means detonating said detonation device when said firing means is moved to said second position, said release means including piston means responsive to said pressure of said fluid in said coiled tubing for moving in response to said pressure, a piston rod connected to said piston means and moving in response to a movement of said piston means, and a release sleeve connected between said piston rod and said holding means for releasing said holding means and allowing said firing means to move to said second position when said piston rod moves in response to the movement of said piston means, and circulation means for reverse circulating said fluid from said annulus space through said firing head to said coiled tubing when said holding means holds said firing means in said first position.

11. The apparatus of claim 10, wherein said circulation means circulates said fluid disposed in said coiled tubing from said coiled tubing through said firing head to said annulus space when said release sleeve releases said holding means and said firing means moves to said second position.

12. The apparatus of claim 11, wherein said circulation means of said firing head comprises:

an outer housing, said outer housing including a first outer wall and a second inner wall separated from said first outer wall and defining an artificial annulus between said first outer wall and said second inner wall;

a first port disposed through said first outer wall and said second inner wall of said outer housing; and a second port disposed through said second inner wall of said outer housing, said circulation means circulating said fluid from said annulus space through said first port, through said second port, into said artificial annulus and into said coiled tubing before said piston means moves and said release sleeve releases said holding means in response to said pressure of said fluid in said coiled tubing.

13. The apparatus of claim 12, wherein said circulation means circulates said fluid disposed in said coiled tubing into said artificial annulus, through said second port, through said first port, and into said annulus space after said piston means moves and said release sleeve releases said holding means in response to said pressure of said fluid in said coiled tubing.

14. The apparatus of claim 13, wherein said detonation device comprises a perforating gun.

15. The apparatus of claim 11, wherein said circulation means of said firing head comprises:

an outer housing, said outer housing including a first outer wall and a second inner wall separated from said first outer wall and defining an artificial annulus between said first outer wall and said second inner wall;

a first port disposed through said first outer wall and said second inner wall of said outer housing; and a second port disposed through said second inner wall of said outer housing, said circulation means circulating said fluid from said annulus space through said first port and into said coiled tubing before said piston means moves and said release sleeve releases said holding means in response to said pressure of said fluid in said coiled tubing.

16. The apparatus of claim 15, wherein said circulation means circulates said fluid disposed in said coiled tubing into said artificial annulus, through said second port, through said first port, and into said annulus space after said piston means moves and said release sleeve releases said holding means in response to said pressure of said fluid in said coiled tubing.

17. The apparatus of claim 16, wherein said detonation device comprises a perforating gun.

18. An apparatus adapted to be lowered into a tubing string in a wellbore, comprising:

a coiled tubing adapted to contain a fluid under pressure;

a firing head adapted to detonate and connected to the coiled tubing, said firing head detonating in response to the pressure of said fluid when said fluid under pressure is contained within said coiled tubing; and a detonation device connected to said firing head, said firing head being connected between said coiled tubing and said detonation device, said firing head including, firing means for moving from a first position to a second position and detonating said detonation device when said firing means is disposed in said second position, holding means for holding said firing means in said first position, and release means responsive to said pressure of said fluid in said coiled tubing for releasing said holding means and allowing said firing means to move from said first position to said second position, said firing means detonating said detonation device when said firing means is moved to said second position, said release means including piston means responsive to said pressure in said coiled tubing for moving in response to said pressure, a connector connected to said piston means and moving in response to a movement of said piston means, and retainer means connected between said connector and said holding means for releasing said holding means and allowing said firing means to move to said second position when said connector moves in response to movement of said piston means.

19. The apparatus of claim 18, wherein an annulus space exists around said apparatus when said apparatus is lowered into said tubing string in said wellbore, a fluid being disposed within said annulus space, said firing head further comprising:

circulation means for reverse circulating said fluid from said annulus space through said firing head to said coiled tubing when said holding means holds said firing means in said first position.

20. The apparatus of claim 19, wherein said circulation means circulates said fluid disposed in said coiled tubing from said coiled tubing through said firing head to said annulus space when said retainer means releases said holding means and said firing means moves to said second position.

21. The apparatus of claim 20, wherein said circulation means of said firing head comprises:

an outer housing, a first port being disposed through a wall of said outer housing;

said piston means adapted to move longitudinally within said outer housing, a second port being disposed through said piston means;

said circulation means circulating said fluid from said annulus space, through said first port in said outer housing, through said second port in said piston means and into said coiled tubing before said piston means moves and before said retainer means releases said holding means in response to said pressure of said fluid in said coiled tubing.

22. The apparatus of claim 21, wherein said circulation means circulates said fluid disposed in said coiled tubing from said coiled tubing, through said first port in said outer housing, and into said annulus space after said piston means and said second port moves and after said retainer means releases said holding means in response to said pressure of said fluid in said coiled tubing.

23. The apparatus of claim 22, wherein said detonation device comprises a perforating gun.

24. A method of detonating a detonation device in a wellbore, a tubing string having a lower end being disposed within said wellbore, comprising the steps of:

lowering an apparatus into said tubing string, said apparatus including a firing head connected between a coiled tubing and said detonation device, an annulus space existing around said apparatus when said apparatus is lowered into said tubing string, a further fluid being disposed in said annulus space, a fluid being disposed in said coiled tubing;

when said detonation device passes said lower end of said tubing string, stopping the lowering of said apparatus into said tubing string;

reverse circulating said further fluid in said annulus space from said annulus space and to said coiled tubing via said firing head and circulating said fluid in said coiled tubing through said firing head; and detonating said detonation device when said fluid in said coiled tubing is circulated through said firing head.

25. The method of claim 24, further comprising the step of:

continuing the circulation of said fluid in said firing head into said annulus space after said detonation device detonates in response to the detonating step.

26. A firing head adapted to be disposed in a wellbore and adapted to detonate when disposed in said wellbore, an annulus existing around said firing head when said firing head is disposed in said wellbore, a fluid being disposed in said annulus, comprising:

an outer housing, said outer housing having a hollow bore at one end adapted to connect to a coiled tubing and including a first outer wall and a second inner wall separated from the first outer wall by an artificial annulus, a first port being disposed through the outer and the inner walls of said outer housing thereby fluidly communicating said fluid in said annulus with an interior of said outer housing, a second port being disposed through said second inner wall thereby fluidly communicating said interior of said outer housing with said artificial annulus;

piston means disposed within and sealingly connected to said second inner wall of said outer housing for moving longitudinally within said inner wall in response to a pressure of a fluid in said coiled tubing and passing through said hollow bore;

release means connected to said piston means for moving longitudinally in response to the movement of said piston means; and firing means connected to said release means for detonating thereby detonating said firing head when said release means moves in response to said movement of said piston means.

27. The firing head of claim 26, wherein said fluid in said coiled tubing is adapted to pass through said hollow bore, propagate through said artificial annulus, flow through said second port, and contact an underside of said piston means, said piston means moving longitudinally within said inner wall in response to said pressure of said fluid contacting said underside of said piston means.

28. The firing head of claim 27, wherein said fluid in said annulus fluidly communicates with said hollow bore and said coiled tubing before said piston mean moves longitudinally within said inner wall of said outer housing.

29. The firing head of claim 28, wherein said fluid in said annulus fluidly communicates with said hollow bore and said coiled tubing via said artificial annulus before said piston mean moves longitudinally within said inner wall of said outer housing.

30. A firing head adapted to be disposed in a wellbore and adapted to detonate when disposed in said wellbore, an annulus existing around said firing head when said firing head is disposed in said wellbore, a fluid being disposed in said annulus, comprising:

an outer housing, said outer housing defining a hollow bore at one end adapted to connect to a coiled tubing and including a port for fluidly communicating said fluid in said annulus with an interior of said outer housing;

piston means disposed within and sealingly connected to said outer housing for moving longitudinally within said outer housing in response to a pressure of a fluid in said coiled tubing and passing through said hollow bore;

release means connected to said piston means for moving longitudinally in response to the movement of said piston means; and firing means connected to said release means for detonating thereby detonating said firing head when said release means moves in response to said movement of said piston means.

31. The firing head of claim 30, wherein said fluid in said coiled tubing is adapted to pass through said hollow bore and contact a top side of said piston means, said piston means moving longitudinally within said outer housing in response to said pressure of said fluid contacting said top side of said piston means.

32. The firing head of claim 31, wherein said piston means includes a port, and wherein said fluid in said annulus flows between said annulus and said coiled tubing via said port in said outer housing, said port in said piston means, and said hollow bore before said piston mean moves longitudinally within said outer housing.

* * * * *